US009465316B2

(12) United States Patent
Hayashi

(10) Patent No.: US 9,465,316 B2
(45) Date of Patent: Oct. 11, 2016

(54) DEVELOPER CONTAINER AND IMAGE FORMING APPARATUS INCLUDING THE SAME

(71) Applicant: KYOCERA Document Solutions Inc., Osaka-shi, Osaka (JP)

(72) Inventor: Koichi Hayashi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/006,528

(22) Filed: Jan. 26, 2016

(65) Prior Publication Data

US 2016/0223945 A1 Aug. 4, 2016

(30) Foreign Application Priority Data

Jan. 30, 2015 (JP) ..... 2015-016939
Jan. 30, 2015 (JP) ..... 2015-016997

(51) Int. Cl.
*G03G 15/08* (2006.01)

(52) U.S. Cl.
CPC ..... *G03G 15/0865* (2013.01); *G03G 15/0832* (2013.01); *G03G 2215/066* (2013.01)

(58) Field of Classification Search
CPC ..... G03G 15/0865; G03G 15/0832; G03G 15/0867; G03G 15/0868; G03G 15/087; G03G 15/0834; G03G 2215/066; G03G 2215/0663; G03G 2215/0685
USPC ..... 399/262, 258; 347/86
See application file for complete search history.

(56) References Cited

U.S. PATENT DOCUMENTS 5,500,665 A * 3/1996 Ujita ..... B41J 2/175 347/86
6,862,420 B1 * 3/2005 Less ..... G03G 15/0884 399/258
2014/0079441 A1 * 3/2014 Abler ..... G03G 15/0865 399/262
2016/0033903 A1 * 2/2016 Eto ..... G03G 15/0867 399/262

FOREIGN PATENT DOCUMENTS

EP 1 076 271 2/2001
JP 2001-92230 4/2001
JP 2012-155274 A * 8/2012

OTHER PUBLICATIONS

Machine translation of JP 2012-155274 (publication date of Aug. 16, 2012) printed on May 4, 2016.*

* cited by examiner

*Primary Examiner* — Sophia S Chen
(74) *Attorney, Agent, or Firm* — Gerald E. Hespos; Michael J. Porco; Matthew T. Hespos

(57) ABSTRACT

A developer container includes a container body and a movable wall. The container body includes an inner surface defining a cylindrical internal space extending in a first direction. The container body is formed with a developer discharge port communicating with the internal space. The movable wall includes a conveying surface defining a storage space for containing the developer in cooperation, and moves in a moving direction parallel with the first direction from an initial position at one end side to a final position at the other end side of the internal space while conveying the developer in the storage space to the developer discharge port. The movable wall that is at the final position allows the conveying surface to extend so obliquely that an upper edge of the conveying surface lies downstream of a lower edge of the conveying surface in the moving direction.

13 Claims, 16 Drawing Sheets

DEVELOPER CONTAINER AND IMAGE FORMING APPARATUS INCLUDING THE SAME

INCORPORATION BY REFERENCE

This application is based on Japanese Patent Application No. 2015-016997 and Japanese Patent Application No. 2015-016939 filed with the Japan Patent Office on Jan. 30, 2015, the contents of which are hereby incorporated by reference.

BACKGROUND

The present disclosure relates to a developer container for containing developer and an image forming apparatus including the developer container.

Conventionally, there is known a developer container for containing developer which is included in an image forming apparatus. The image forming apparatus includes an image carrier, a developing device, and the developer container. The developing device supplies developer to the image carrier to develop an electrostatic latent image formed on the image carrier into a developed image. The developer container includes a developer discharge port through which replenishment developer is supplied into a replenishment port formed in the developing device.

Further, there is known a developer container including a wall section which moves to a developer discharge port while conveying developer.

SUMMARY

A developer container according to an aspect of the present disclosure includes a container body and a movable wall. The container body includes an inner surface defining a cylindrical internal space extending in a first direction. The container body is formed with a developer discharge port communicating with the internal space for discharging developer therethrough. The movable wall includes an outer surface disposed slidably in close contact with the inner surface of the container body, and a conveying surface defining a storage space for containing the developer in cooperation with the inner surface of the container body. The movable wall moves in a moving direction parallel the first direction from an initial position at one end side to a final position at the other end side of the internal space while conveying the developer in the storage space to the developer discharge port. The movable wall that is at the final position allows the conveying surface to extend so obliquely that an upper edge of the conveying surface lies downstream of a lower edge of the conveying surface in the moving direction.

An image forming apparatus according to another aspect of the present disclosure includes an apparatus body, the above-described developer container, an image carrier, a developing device, and a transfer section. The developer container can be attached to and detached from the apparatus body. The image carrier has a surface for allowing an electrostatic latent image to be formed thereon, and carries a developed image. The developing device receives the developer supplied from the developer container and supplies the developer to the image carrier. The transfer section transfers the developed image from the image carrier onto a sheet.

These and other objects, features and advantages of the present disclosure will become more apparent upon reading the following detailed description along with the accompanying drawings.

DETAILED DESCRIPTION

Figure 1:
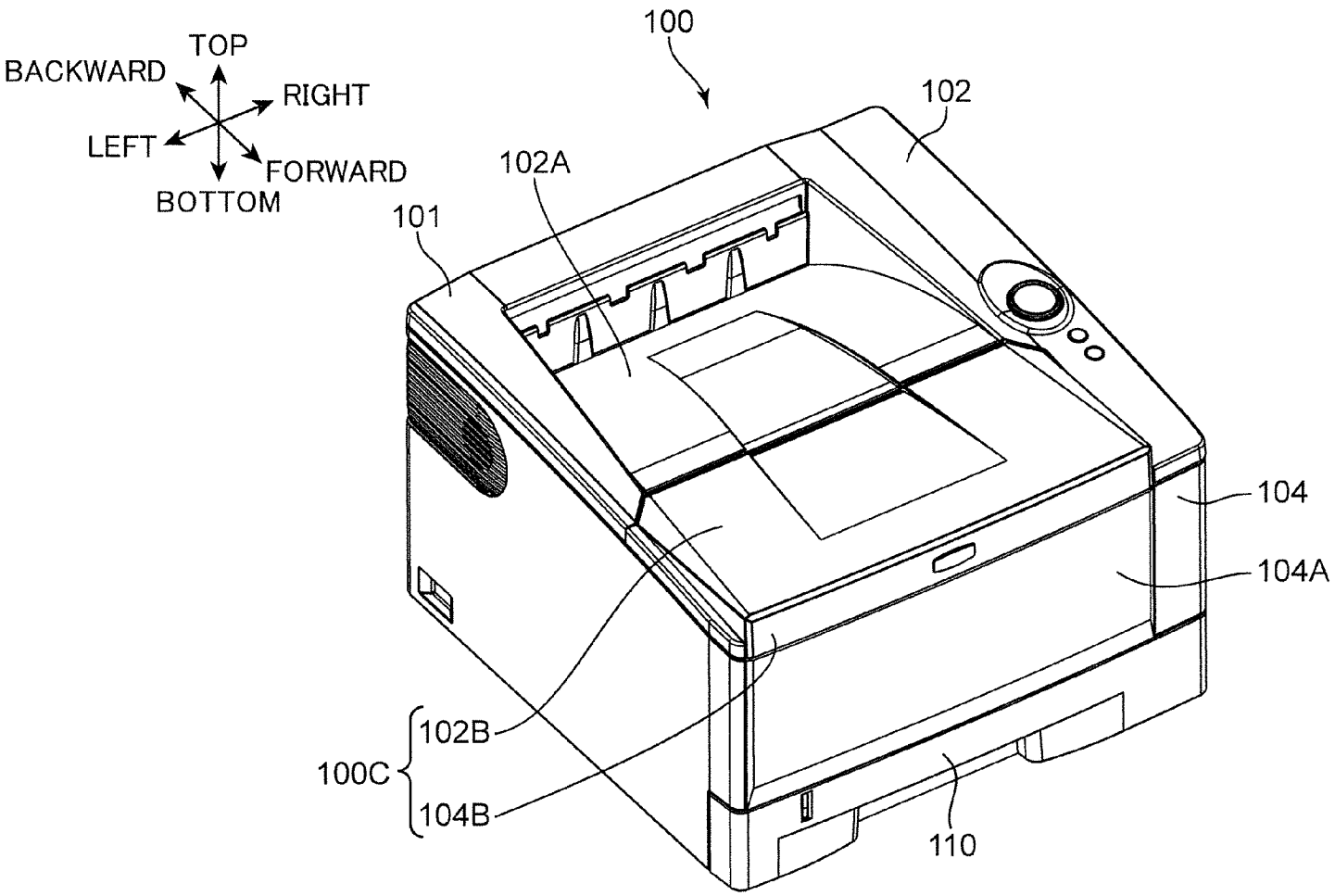
FIG. 1 is a perspective view of an image forming apparatus according to a first embodiment of the present disclosure.
Figure 2:
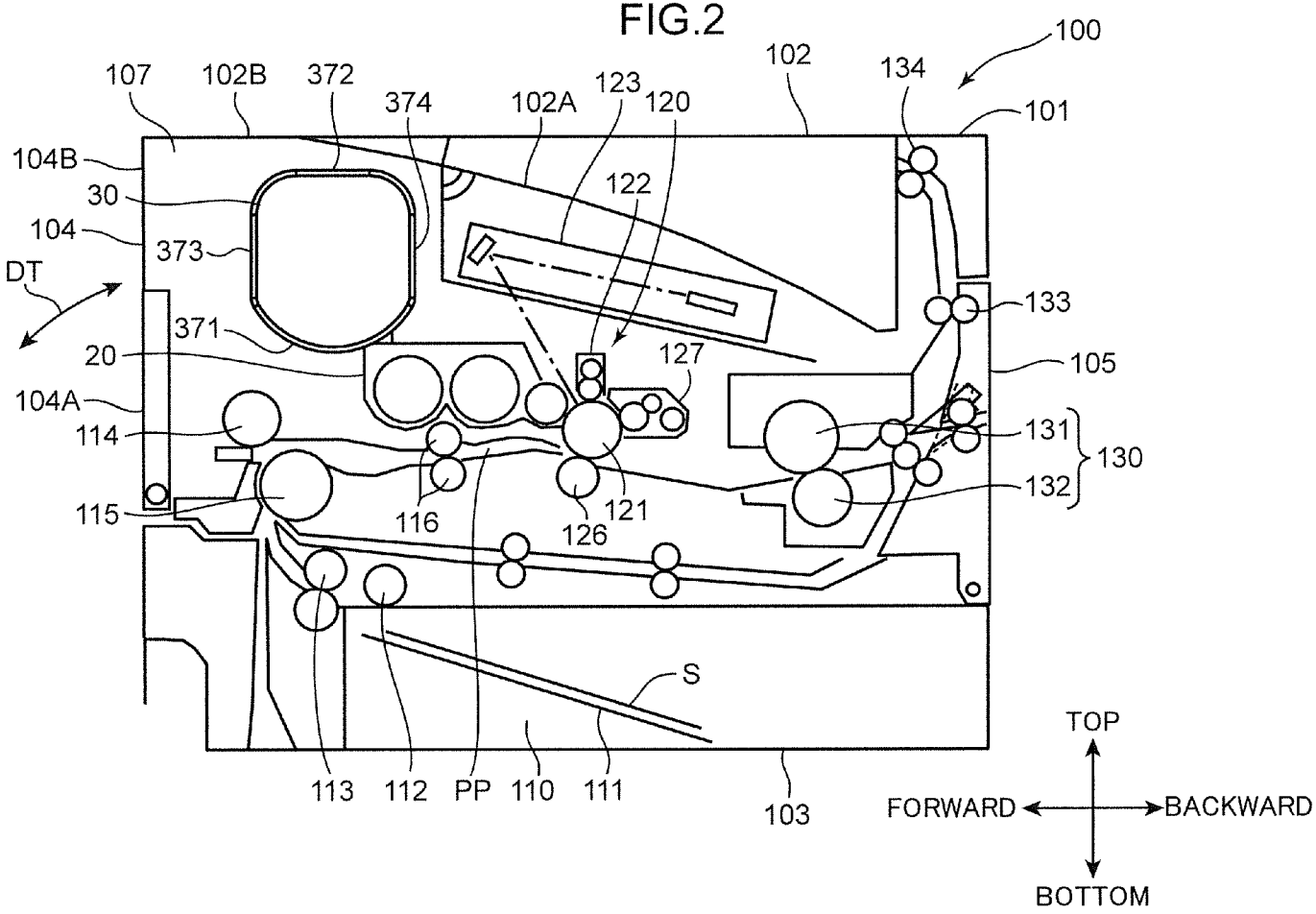
FIG. 2 is a schematic sectional view showing an internal structure of the image forming apparatus according to the first embodiment of the present disclosure.

Hereinafter, a first embodiment of the present disclosure will be described with reference to the accompanying drawings. FIG. 1 is a perspective view of a printer (image forming apparatus) 100 according to a first embodiment of the present disclosure. FIG. 2 is a schematic sectional view showing an internal structure of the printer 100 shown in FIG. 1. The printer 100 shown in FIGS. 1 and 2, which exemplifies the image forming apparatus, is a so-called monochrome printer. However, other apparatuses may alternatively be provided as the image forming apparatus in other embodiments, such as a color printer, a facsimile apparatus or a multifunctional apparatus equipped with these functions, or another type of apparatus for forming a toner image on a sheet. It should be noted that hereinafter, terms indicating directions such as "top" "bottom" "forward" "backward" "left" and "right" are intended merely for descriptive purposes, and not for limiting the principle of the image forming apparatus.

The printer 100 includes a housing 101 for housing various components that are used for forming an image on a sheet S. The housing 101 includes a top wall 102 defining the top surface of the housing 101, a bottom wall 103 (FIG. 2) defining the bottom surface of the housing 101, a main body rear wall 105 (FIG. 2) connecting the top wall 102 and the bottom wall 103, and a main body front wall 104 located in front of the main body rear wall 105. The housing 101 includes a main body internal space 107 where various components are placed. A sheet conveyance passage PP extends in the main body internal space 107 of the housing 101, the sheet conveyance passage PP for allowing passage of a sheet S in a given conveying direction. Further, the printer 100 includes an opening/closing cover 100C mounted on the housing 101 in an openable and closable manner.

The opening/closing cover 100C includes a front wall upper portion 104B constituting an upper portion of the main body front wall 104, and a top wall front portion 102B constituting a front portion of the top wall 102. When the opening/closing cover 100C is open, the main body internal space 107 is exposed to the outside at the top to allow attachment and detachment of a toner container 30 described later.

A sheet discharge section 102A is disposed in a central part of the top wall 102. The sheet discharge section 102A includes an oblique surface sloping downward from a front end to a rear end of the top wall 102. A sheet S that has been subjected to image formation in an image forming section 120 described later is discharged onto the sheet discharge section 102A. Further, a manual feed tray 104A is disposed in a vertically central part of the main body front wall 104. The manual feed tray 104A is vertically pivotable with a lower end thereof acting as a fulcrum (in the direction of an arrow DT shown in FIG. 2).

With reference to FIG. 2, the printer 100 includes a sheet feeder cassette 110, a pickup roller 112, a first sheet feeder roller 113, a second sheet feeder roller 114, a conveyor roller 115, a pair of registration rollers 116, the image forming section 120, and a fixing device 130.

The sheet feeder cassette 110 stores sheets S therein. The sheet feeder cassette 110 includes a lift plate 111. The lift plate 111 is tilted to lift the leading edges of the sheets S. The sheet feeder cassette 110 can be pulled out forwardly with respect to the housing 101.

The pickup roller 112 is disposed above a leading edge of a sheet S lifted by the lift plate 111. The pickup roller 112 rotates to draw the sheet S from the sheet feeder cassette 110.

The first sheet feeder roller 113 is disposed downstream of the pickup roller 112 and conveys a sheet S further downstream. The second sheet feeder roller 114 draws a sheet S placed on the manual feed tray 104A into the housing 101.

The conveyor roller 115 is disposed downstream of the first sheet feeder roller 113 and the second sheet feeder roller 114 in their sheet conveying direction (hereinafter, the sheet conveying direction also being referred to simply as "conveying direction", and the downstream in the sheet conveying direction also being referred to simply as "downstream"). The conveyor roller 115 conveys a sheet S fed by the first sheet feeder roller 113 or the second sheet feeder roller 114 further downstream.

The pair of registration rollers 116 functions to correct the angle of a sheet S that has been obliquely conveyed. This makes it possible to adjust the position of an image to be formed on the sheet S. The pair of registration rollers 116 supplies the sheet S to the image forming section 120 in accordance with timing of image formation to be performed by the image forming section 120.

The image forming section 120 includes a photoconductive drum (image carrier) 121, a charger 122, an exposure device 123, a developing device 20, the toner container (developer container) 30, a transferring roller (transfer section) 126, and a cleaning device 127.

The photoconductive drum 121 is in the form of a cylinder. The photoconductive drum 121 has a surface to be formed with an electrostatic latent image, and carries a toner image (developed image) corresponding to the electrostatic latent image on the surface. The charger 122 is applied with a predetermined voltage, and charges the circumferential surface of the photoconductive drum 121 substantially uniformly.

The exposure device 123 irradiates the circumferential surface of the photoconductive drum 121 charged by the charger 122 with beams of laser light. The beams of laser light are emitted in accordance with image data output from an external device such as personal computer (not shown) which is communicably connected to the printer 100. Consequently, the circumferential surface of the photoconductive drum 121 is formed with an electrostatic latent image corresponding to the image data.

The developing device 20 supplies toner to the circumferential surface of the photoconductive drum 121, the circumferential surface being formed with an electrostatic latent image. The toner container 30 supplies toner (replenishment developer) to the developing device 20. The toner container 30 is detachably attached to the developing device 20 in the housing 101. Upon supply of toner from the developing device 20 to the photoconductive drum 121, the electrostatic latent image formed on the circumferential surface of the photoconductive drum 121 is developed (visualized). Consequently, the circumferential surface of the photoconductive drum 121 is formed with a toner image (developed image).

The transferring roller 126 is disposed below and opposite to the photoconductive drum 121 across the sheet conveyance passage PP. The transferring roller 126 defines a transfer nip in cooperation with the photoconductive drum 121 for transferring a toner image onto a sheet S. The cleaning device 127 removes, after a toner image is transferred onto a sheet S from the circumferential surface of the photoconductive drum 121, toner remaining on the circumferential surface.

The fixing device 130 is disposed downstream of the image forming section 120 in the conveying direction, and fixes a toner image on a sheet S. The fixing device 130 includes a heating roller 131 for melting toner on a sheet S, and a pressure roller 132 for bringing the sheet S into close contact with the heating roller 131.

The printer 100 further includes a pair of conveyor rollers 133 disposed downstream of the fixing device 130, and a pair of discharge rollers 134 disposed downstream of the pair of conveyor rollers 133. A sheet S is conveyed upward by the pair of conveyor rollers 133 to be finally discharged from the housing 101 by the pair of discharge rollers 134.

The sheet S discharged from the housing 101 is placed on the sheet discharge section 102A, thereby resulting in a stack of sheets S.

<Developing Device>

Figure 3:
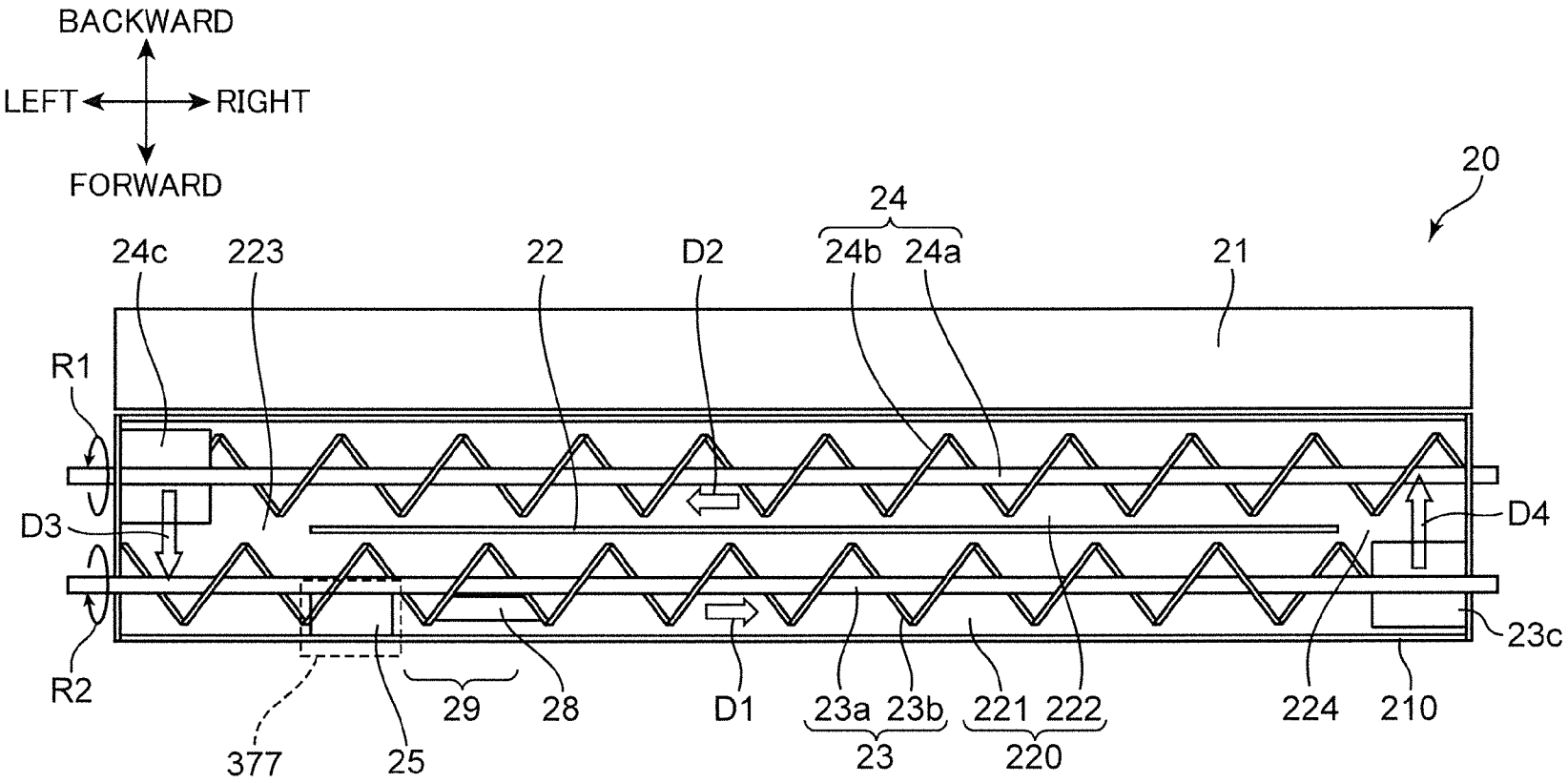
FIG. 3 is a schematic plan view showing an internal structure of a developing device according to the first embodiment of the present disclosure.

FIG. 3 is a plan view showing an internal structure of the developing device 20. The developing device 20 includes a development housing 210 in the form of a box having a longer dimension in a specific direction (an axial direction of a developing roller 21 or a left-right direction). The development housing 210 includes a storage space 220. In the storage space 220, there are disposed the developing roller 21, a first stirring screw 23, a second stirring screw 24, and a toner replenishment port 25. The present embodiment employs a magnetic one-component developing method and, therefore, the storage space 220 is filled with magnetic toner that is to be used as developer.

The developing roller 21 is in the form of a cylinder extending in the longitudinal direction of the development housing 210, and includes a sleeve constituting a circumferential portion of the developing roller 21 and configured to be rotationally driven. The storage space 220 of the development housing 210 is covered by an unillustrated top portion and divided, by a partition plate 22 extending in the left-right direction, into a first conveyance passage 221 and a second conveyance passage 222 having a longer dimension in the left-right direction. The partition plate 22 is shorter than the lateral width of the development housing 210 to define a first communication passage 223 and a second communication passage 224 respectively at the left and right sides of the partition plate 22, the first and second communication passages 223 and 224 allowing communication between the first conveyance passage 221 and the second conveyance passage 222. Consequently, there is a circulation passage constituted by the first conveyance passage 221, the second communication passage 224, the second conveyance passage 222, and the first communication passage 223 in the storage space 220. Toner is conveyed through the circulation passage counterclockwise in FIG. 3.

The toner replenishment port (developer replenishment port) 25 is an opening formed in the top portion of the development housing 210, and is disposed above and near a left end of the first conveyance passage 221. The toner replenishment port 25 faces the above-mentioned circulation passage, and functions to allow replenishment toner (replenishment developer) supplied from a toner discharge port 377 (FIG. 3) of the toner container 30 to flow into the storage space 220.

The first stirring screw 23 is disposed in the first conveyance passage 221. The first stirring screw 23 includes a first rotary shaft 23*a*, and a first spiral blade 23*b* in the form of a spiral protrusion formed on the circumferential surface of the first rotary shaft 23*a*. The first stirring screw 23 is driven to rotate around the axis of the first rotary shaft 23*a* (in the direction of an arrow R2) to convey toner in the direction of an arrow D1 shown in FIG. 3. A first paddle 23*c* is disposed in a downstream part of the first stirring screw 23 in the toner conveying direction (in the arrow D1 direction). The first paddle 23*c* delivers toner from the first conveyance passage 221 to the second conveyance passage 222 in the direction of an arrow D4 shown in FIG. 3.

The second stirring screw 24 is disposed in the second conveyance passage 222. The second stirring screw 24 includes a second rotary shaft 24*a*, and a second spiral blade 24*b* in the form of a spiral protrusion formed on the circumferential surface of the second rotary shaft 24*a*. The second stirring screw 24 is driven to rotate around the axis of the second rotary shaft 24*a* (in the direction of an arrow R1) to supply toner to the developing roller 21 while conveying toner in the direction of an arrow D2 shown in FIG. 3. A second paddle 24*c* is disposed in a downstream part of the second stirring screw 24 in the toner conveying direction (in the arrow D2 direction). The second paddle 24 delivers toner from the second conveyance passage 222 to the first conveyance passage 221 in the direction of an arrow D3 shown in FIG. 3.

The toner container 30 (FIG. 2) is disposed above the toner replenishment port 25 of the development housing 210. The toner container 30 includes the toner discharge port 377 (FIG. 3). The toner discharge port 377 is disposed at a bottom portion 371 (FIG. 6) of the toner container 30 and corresponds to the toner replenishment port 25 of the development housing 20. Toner falling through the toner discharge port 377 passes through the toner replenishment port 25, thereby being supplied to the development device 20.

<Supply of Toner>

Figure 4:
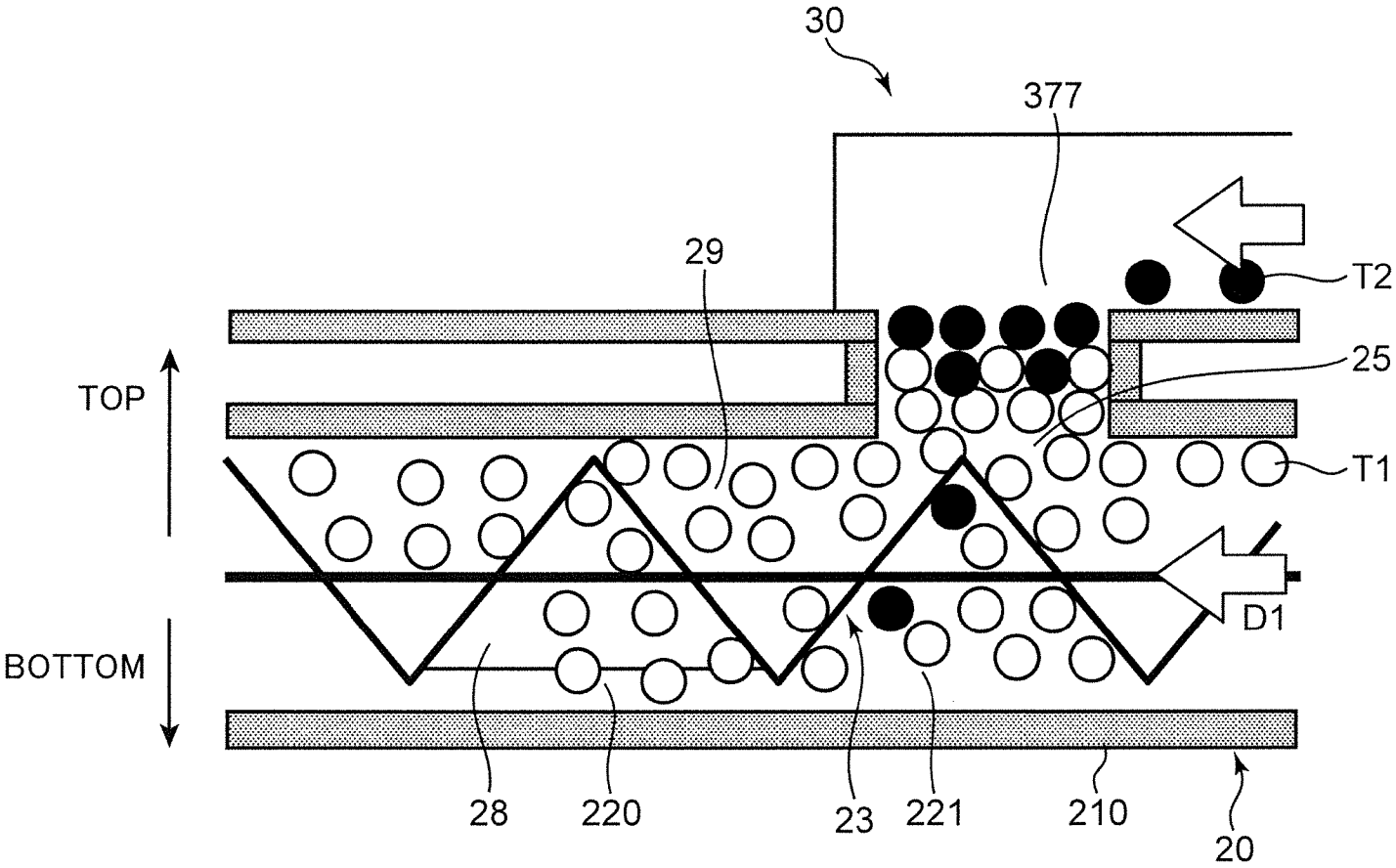
FIG. 4 is schematic sectional view illustrating supply of developer to the developing device according to the first embodiment of the present disclosure.

Now, there will be described a flow of toner that is newly supplied through the toner replenishment port 25. FIG. 4 is a sectional view of the vicinity of the toner replenishment port 25 disposed in the developing device 20 and the toner discharge port 377 disposed in the toner container 30.

Replenishment toner T2 that is supplied through the toner discharge port 377 of the toner container 30 falls into the first conveyance passage 221 to be mixed with existing toner T1, and the mixture of toners T1 and T2 are conveyed in the arrow D1 direction by the first stirring screw 23. At this time, the toners T1 and T2 are stirred and charged.

The first stirring screw 23 includes a reducing paddle (conveying ability reducing portion) 28 disposed downstream of the toner replenishment port 25 in the toner conveying direction, the reducing paddle for partially reducing the ability of conveying toner. In the present embodiment, the reducing paddle 28 is in the form of a plate-like member extending between a particular advancing point and a particular receding point of a turn of the first spiral blade 23*b* of the first stirring screw 23. The reducing paddle 28 rotates with the first rotary shaft 23*a* to cause toner being conveyed from the upstream side of the reducing paddle 28 to begin to accumulate. The accumulation of toner grows up to immediately upstream of the reducing paddle 28, that is, a portion where the toner replenishment port 25 faces the first conveyance passage 221. As a result, a toner accumulation portion (developer accumulation portion) 29 appears near the inlet of the toner replenishment port 25. In another embodiment, the conveying ability reducing portion may alternatively be defined by a specific part of the first stirring screw 23 where the first rotary shaft 23*a* is partially exposed along its axis with no first spiral blade 23*b*. Also in this configuration, the conveying ability of the first stirring screw 23 is partially reduced, which therefore allows formation of toner accumulation portion.

When the amount of toner in the storage space 220 has increased due to the supply of replenishment toner T2 though the toner replenishment port 25, the toner of the accumulation portion 29 covers (seals) the toner replenishment port 25, which prevents further toner supply. Thereafter, as the toner of the accumulation portion 29 decreases in amount because of consumption of the toner in the storage space 220 by the developing roller 21, the amount of toner covering the toner replenishment port 25 decreases such that a gap appears between the accumulation portion 29 and the toner replenishment port 25. This allows new inflow of replenishment toner T2 into the storage space 220 through the toner replenishment port 25. In this manner, the present embodiment employs the volume replenishment type toner supply method in which the amount of replenishment toner to be received is adjusted in accordance with a decrease in the amount of toner of the accumulation portion 29.

<Structure of Toner Container>

Figure 5:
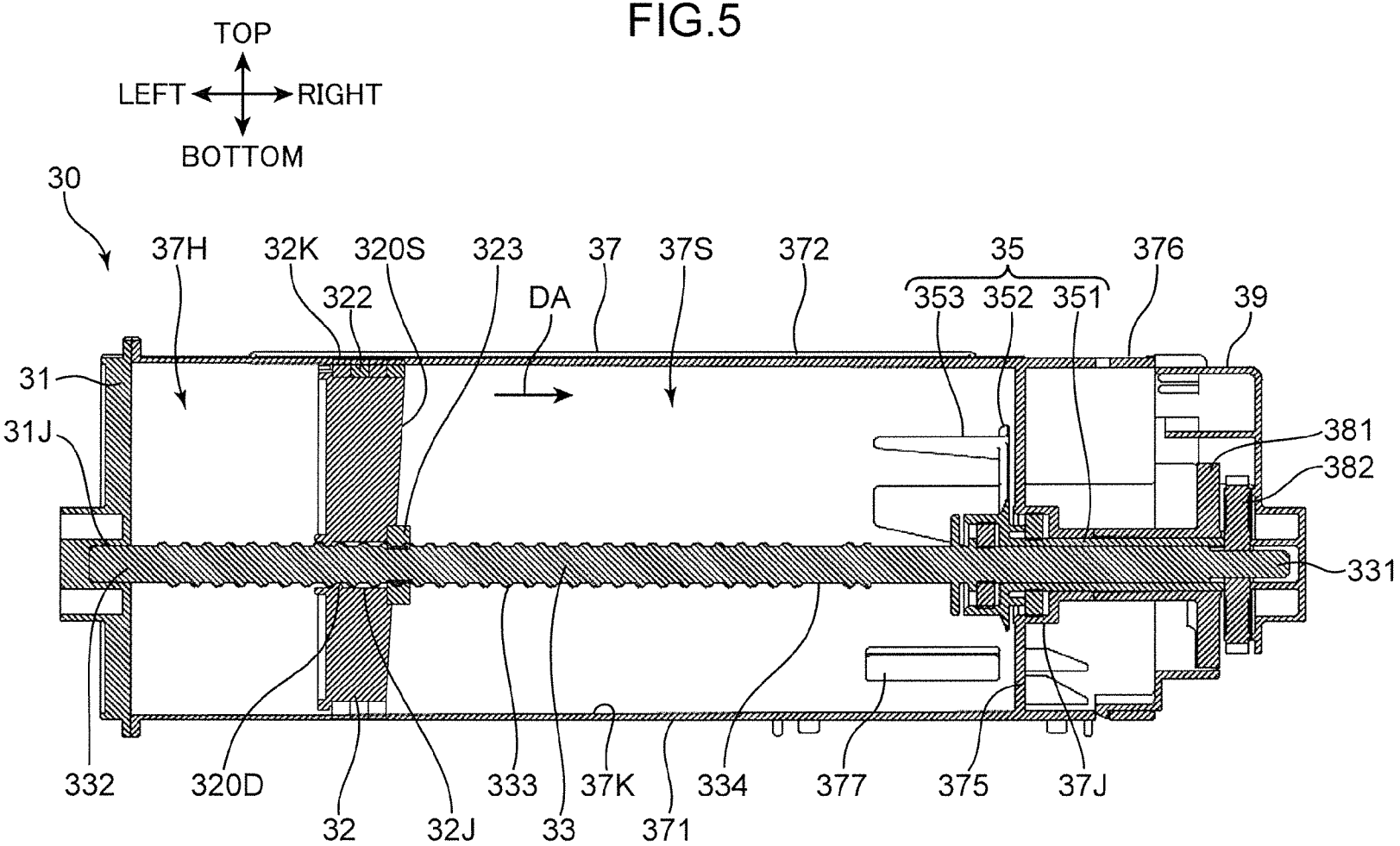
FIG. 5 is a sectional view of a developer container according to the first embodiment of the present disclosure.
Figure 6:
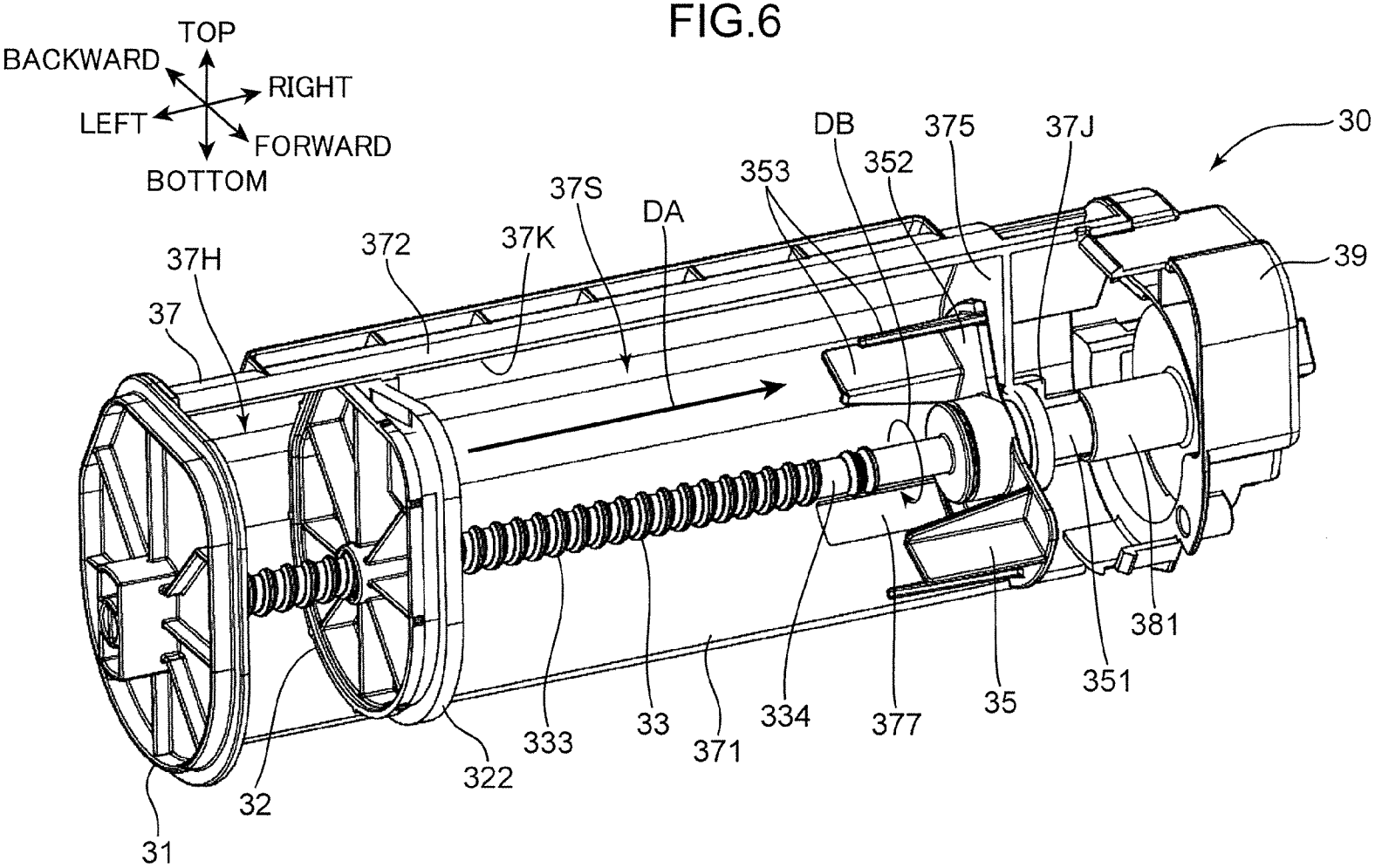
FIG. 6 is a perspective view showing the inside of the developer container according to the first embodiment of the present disclosure.
Figure 7:
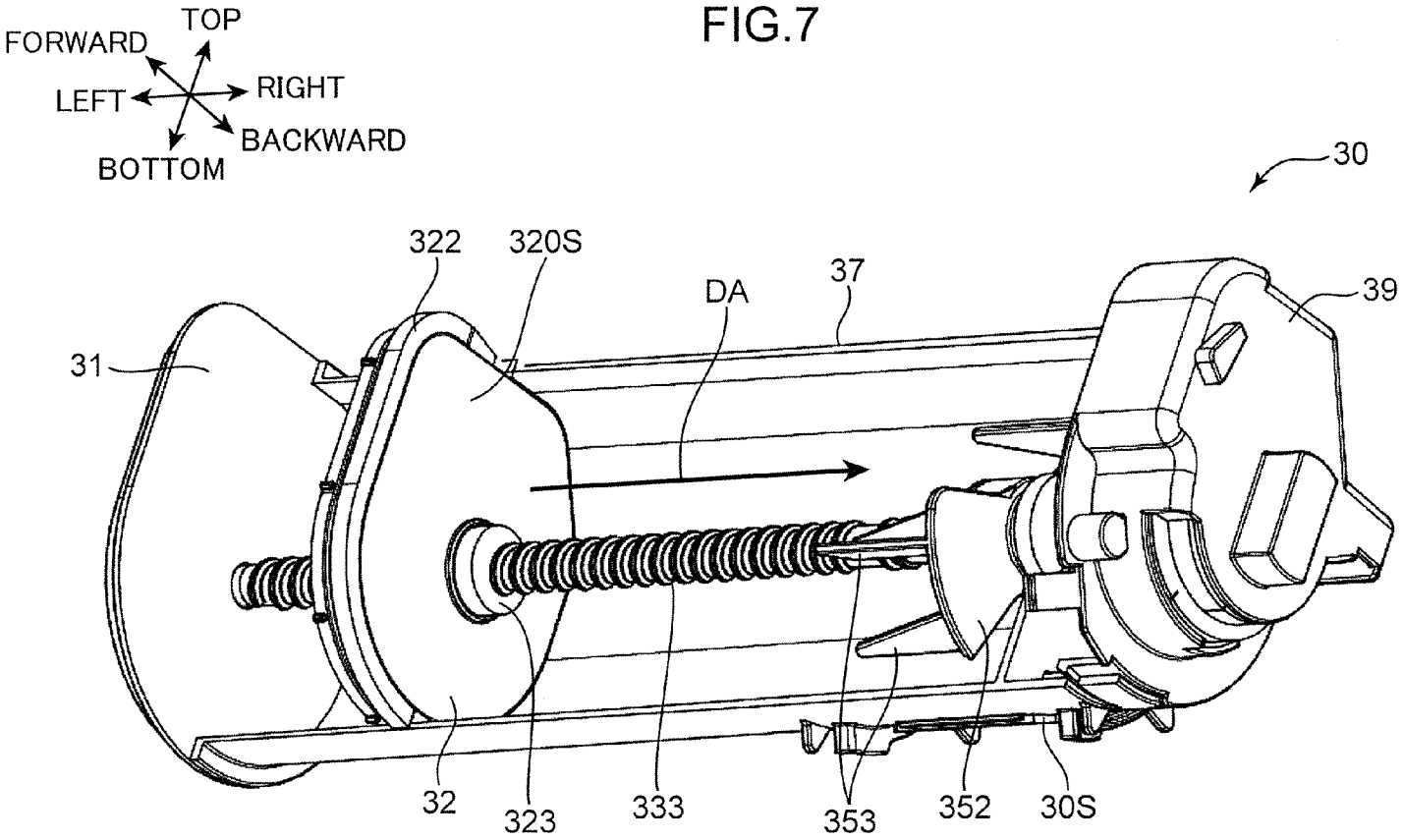
FIG. 7 is a perspective view showing the inside of the developer container according to the first embodiment of the present disclosure.

Now the toner container (developer container) 30 according to the first embodiment of the present disclosure will be described with reference to FIGS. 5 to 7. FIG. 5 is a sectional view of the toner container 30 according to the first embodiment. FIGS. 6 and 7 are perspective views showing the inside of the toner container 30 according to the first embodiment. It should be noted that FIGS. 6 and 7 are perspective views of the toner container 30, with a part of a container body 37 described later omitted.

The toner container 30 is in the form of a cylinder extending in the left-right direction (in a first direction or the direction of an arrow DA shown in FIG. 5). The toner container 30 contains replenishment toner (developer). With reference to FIG. 5, the toner container 30 includes a lid 31, a movable wall 32, a shaft 33, a stirring member 35, the container body (container body) 37, an unillustrated toner sensor, a first gear 381, a second gear 382, and a cover 39.

The lid 31 is secured to the container body 37 to seal the opening of the container body 37. The lid 31 includes a lid shaft hole 31J. The lid shaft hole 31J is formed in a central portion of the lid 31 to rotatably and axially support the shaft 33. The lid shaft hole 31J is formed to extend a predetermined length leftward from a right surface (inner surface) of the lid 31.

The container body 37 constitutes the body of the toner container 30 and is in the form of a cylinder. The container body 37 includes an inner surface (inner surface) 37K and an internal space 37H. The inner surface 37K defines the internal space 37H described later in the form of a cylinder extending in a longitudinal direction of the toner container 30 (in the first direction or the arrow DA direction shown in FIG. 5).

Further, the container body 37 includes the bottom portion 371, a top portion 372, a front wall 373 (FIG. 2), a rear wall 374 (FIG. 2), a right wall 375 (FIG. 5) and a projecting wall 376 (FIG. 5). The bottom portion 371 constitutes the bottom of the container body 37 and is in the form of a half cylinder projecting downward. In other words, the bottom portion 371 has an arc shape in a sectional view perpendicularly intersecting the first direction. The front wall 373 and the rear wall 374 are a pair of side walls standing on the opposite lateral ends of the bottom portion 371. The top portion 372 is disposed above the bottom portion 371 to cover the internal space 37H from above. The right wall 375 joins one end (right end) of each of the bottom portion 371, the front wall 373, the rear wall 374, and the top portion 372 in the first direction, thereby closing the container body 37. The internal space 37H is a space defined by the bottom portion 371, the top portion 372, the front wall 373, the rear wall 374, the right wall 375 and the lid 31. The internal space 37H includes a storage space 37S defined between the right wall 375 and the movable wall 32. The storage space 37S is a space for containing toner in the toner container 30.

One end of the container body 37 that is opposite to the right wall 375 in the first direction is open. The above-mentioned lid 31 closes the opening of the container body 37. The circumferential edge of the lid 31 is attached to the container body 37 by ultrasonic welding. With reference to FIG. 5, the projecting wall 376 is the part of the outer circumferential portion of the container body 37 that projects rightward of the right wall 375. The cover 39 is attached to the projecting wall 376.

Further, the container body 37 includes the toner discharge port (developer discharge port) 377, a shutter 30S (FIG. 7) and a main body bearing 37J. The toner discharge port 377 is formed in a lower portion of the container body 37 and communicates with the internal space 37H. As shown in FIG. 5, the toner discharge port 377 is formed at a right end side of the container body 37. In other words, the toner discharge port 377 is disposed adjacent to the right wall 375 in the first direction. The toner discharge port 377 is a rectangular opening having a predetermined length in the first direction and a predetermined width along the arc shape of the bottom portion 371. In the present embodiment, the toner discharge port 377 is formed at a position circumferentially behind and above a lowest part of the bottom portion 371.

The toner contained in the storage space 37S is discharged through the toner discharge port 377 toward the developing device 20. In the present embodiment, as described above, the internal space 37 H of the container body 37 is defined by the bottom portion 371, the front wall 373, the rear wall 374, and the top portion 372. Therefore, the toner in the storage space 37S concentrates at the arc-shaped bottom portion 371 by its own weight. This allows the toner that is conveyed by the movable wall 32 described later to be efficiently discharged through the toner discharge port 377.

The shutter 30S (FIG. 7) is slidably disposed at a right end of the container body 37. The shutter 30S closes (seals) the toner discharge port 377 from the outside of the container body 37, and exposes the toner discharge port 377 to the outside. The shutter 30S is able to slide cooperatively with mounting of the toner container 30 to the developing device 20.

The main body bearing 37J is formed in the right wall 375. The main body bearing 37J is in the form of a cylinder projecting rightward from a central part of the right wall 375. The shaft 33 passes through the main body bearing 37J with a right end of the shaft 33 projecting out of the container body 37. Further, in the cylindrical main body bearing 37J, a part (a stirring bearing 351) of the stirring member 35 is placed in the space between the main body bearing 37J and the shaft 33.

The movable wall 32 is a wall disposed in the container body 37 (internal space 37H) and extending in a direction perpendicularly intersecting the first (horizontal) direction. The movable wall 32 defines one end surface (left end surface) of the storage space 37S in the first direction. The other end surface (right end surface) of the storage space 37S in the first direction is defined by the right wall 375. During a time period from the beginning to the end of use of the toner container 30, the movable wall 32 moves in a moving direction parallel with the first direction from an initial position at one end side to a final position at the other end side of the internal space 37H while conveying toner in the storage space 37S to the toner discharge port 377. In the present embodiment, the initial position of the movable wall 32 is on the right side (downstream side in the moving direction) of the lid 31, and the final position is on the immediate left side (upstream side in the moving direction) of the toner discharge port 377.

With reference to FIGS. 5 to 7, the movable wall 32 defines the storage space 37S in cooperation with the inner surface 37K of the container body 37. The movable wall 32 includes a conveying surface 320S, an inner wall seal 322, a shaft seal 323, a carrier bearing 32J, and an outer surface (outer surface) 32K.

The conveying surface 320S intersects the axis of the shaft 33. The conveying surface 320S conveys toner in the storage space 37S by pressing it according to the movement of the movable wall 32. The conveying surface 320S extends slightly obliquely with respect to a vertical direction. The conveying surface 320S will be described in detail later.

The carrier bearing 32J is a bearing formed in a substantially central part of the movable wall 32. In other words, the carrier bearing 32J moves in the moving direction while holding the movable wall 32. The shaft 33 described later passes through the carrier bearing 32J.

The carrier bearing 32J includes a female thread 320D. The female thread 320D is in the form of a helical ridge projecting from an inner surface of the carrier bearing 32J. The female thread 320D functions to move the movable wall 32 in the moving direction by engaging with a male thread 333 of the shaft 33 described later.

The inner wall seal 322 is a sealing member disposed to ride on the outer periphery of the movable wall 32. The inner wall seal 322 includes an elastic member made of urethane sponge. The inner wall seal 322 is resiliently compressed between the inner surface 37K of the container body 37 and the movable wall 32. The inner wall seal 322 constitutes the outer surface 32K of the movable wall 32. The outer surface 32K is disposed slidably in close contact with the inner surface 37K of the container body 37. The inner wall seal 322 prevents toner in the storage space 37S from flowing out to the upstream side of the movable wall 32 in the moving direction through the gap between the inner surface 37K of the container body 37 and the movable wall 32.

The shaft seal 323 is secured to the carrier bearing 32J at the downstream side of the female thread 320D in the moving direction of the movable wall 32 (FIGS. 5 and 7). The shaft seal 323 includes an elastic member made of urethane sponge. The shaft seal 323 comes in contact with the male thread 333 earlier than the female thread 320D to clean toner adhering to the male thread 333. This makes it possible to prevent toner from aggregating between the male thread 333 and the female thread 320D and consequently allow stable movement of the movable wall 32. In addition, the shaft seal 323 is in the form of a ring allowing the shaft 33 to pass therethrough, and is therefore in close contact with the shaft 33 over the entire circumference of the shaft 33. This makes it possible to prevent toner in the storage space 37S from flowing out to the upstream side of the movable wall 32 in the moving direction through the carrier bearing 32J.

The shaft 33 extends in the moving direction in the internal space 37H and is rotatably supported on the right wall 375 of the container body 37 and the lid 31. The shaft 33 includes a first shaft end portion 331, a second shaft end portion 332, the male thread 333, and a movable wall stopper portion 334.

With reference to FIG. 5, the first shaft end portion 331 is the right end portion of the shaft 33 that projects rightward of the main body bearing 37J. The second shaft end portion 332 is a left end portion of the shaft 33. The second shaft end portion 332 is axially supported on the lid shaft hole 31J formed in the lid 31.

The male thread 333 is in the form of a helical ridge projecting from an outer surface of the shaft 33 in the internal space 37H. In the present embodiment, as shown in FIG. 5, the male thread 333 extends on the shaft from an area adjacent to the lid 31 to an area at the upstream side of the toner discharge port 377 in the moving direction (in the arrow DA direction shown in FIG. 5).

The movable wall stopper portion 334 is disposed continuously to a downstream end of the male thread 333 in the moving direction. The movable wall stopper portion 334 is defined by a specific part of the 33 disposed in the internal space 37H, the specific part bearing no male thread 333.

The stirring member 35 (FIG. 5) is disposed above the toner discharge port 377 and along the right wall 375. The stirring member 35 stirs toner in the storage space 37S and causes the toner to flow out through the toner discharge port 377. In the present embodiment, the stirring member 35 rotates around and with respect to the shaft 33. In FIG. 6, the stirring member 35 rotates in the direction of an arrow DB. The stirring member 35 includes a stirring bearing 351, a pair of stirring supporting portions 352, and stirring blades 353.

The stirring bearing 351 is in the form of a cylinder and fitted on the shaft 33. The stirring bearing 351 is inserted into the main body bearing 37J from the storage space 37S side of the container body 37. As a result, a right end of the stirring bearing 351 passes through the main body bearing 37J and is exposed outside of the right wall 375 (main body bearing 37J) of the container body 37. On the other hand, a left end of the stirring bearing 351 lies in the storage space 37S.

The stirring supporting portions 352 are in the form of projections each extending in a radial direction of rotation of the shaft 33 from the left end of the cylindrical stirring bearing 351. The stirring supporting portions 352 extend in a direction facing the moving direction and along the right wall 375. The stirring supporting portions 352 rotate around the shaft 33 in the storage space 37S. In particular, in the present embodiment, the pair of stirring supporting portions 352 extend in radially opposite directions (FIG. 6), and are each in the form of a propeller having a circumferential width which increases radially outward (FIG. 7).

Each of the pair of stirring supporting portions 352 holds two stirring members 353 in the form of blade members projecting leftward (upstream in the moving direction) from the stirring supporting portion 352. As shown in FIGS. 6 and 7, the two stirring blades 353 of each stirring supporting portion 352 are spaced apart from each other in a circumferential direction of rotation of the stirring member 35. The stirring blades 353 circularly move above the toner discharge port 377 to stir toner around the toner discharge port 377 and cause the toner to flow out through the toner discharge port 377.

The first gear 381 is connected with the stirring bearing 351 of the stirring member 35 and transmits a torque to the stirring member 35. The first gear 381 is connected with a specific motor via an unillustrated transmission gear of the developing device 20. The stirring member 35 is controlled to rotate by an unillustrated controller independently of the developing roller 21 of the developing device 20.

The second gear 382 transmits a torque to the shaft 33. The second gear 382 is connected (secured) to a leading end (the first shaft end portion 331) of the shaft 33 passing through the stirring bearing 351. The second gear 382 is connected with the specific motor via the unillustrated transmission gear of the developing device 20. The shaft 33 is controlled to rotate by the unillustrated controller independently of the stirring member 35 to move the movable wall 32 in the moving direction.

The cover 39 is attached to the projecting wall 376 of the container body 37. The cover 39 functions to expose a part of a circumferential surface of each of the first gear 381 and the second gear 382 and cover the remaining part of the circumferential surface of each of the first gear 381 and the second gear 382.

The toner sensor is disposed on the bottom portion 371 of the container body 37. The toner sensor is disposed circumferentially adjacent to the toner discharge port 377 and, in the present embodiment, is secured to the lowest part of the bottom portion 371. The toner sensor includes a magnetic permeability sensor or a piezoelectric element. In the case that the toner sensor includes a piezoelectric element, a sensing portion of the toner sensor is exposed to the storage space 37S. The toner sensor outputs a HIGH signal (+5V) in response to being pressed by toner in the storage space 37S. Further, when almost no toner exists above the toner sensor, the toner sensor outputs a LOW signal (0V). A signal outputted by the toner sensor is referred to by the unillustrated controller. In the case that the toner sensor includes a magnetic permeability sensor, the sensor does not need to make direct contact with toner. Therefore, in other embodiments, the toner sensor may be disposed on the development housing 210 of the developing device 20 in such a manner as to face an outer surface of the container body 37. Further, the toner sensor is not limited to be disposed on the bottom portion 371. In other embodiments, the toner sensor may be disposed on any one of the top portion 372, the front wall 373, and the rear wall 374 of the container body 37, for example.

<Movement of Movable Wall>

When the toner container 30 is newly mounted in the printer 100, the controller drives the shaft 33 for rotation via the second gear 382. This brings the male thread 333 of the shaft 33 into engagement with the female thread 320D of the movable wall 32 to thereby move the movable wall 32 in the moving direction (in the direction of an arrow DA shown in FIGS. 5 to 7) toward the toner discharge port 377. When the movable wall 32 has moved a predetermined distance rightward from the initial position, the storage space 37S is filled up with toner, so that the toner sensor outputs the HIGH signal in accordance with the filling state. Upon receipt of the HIGH signal outputted from the toner sensor, the controller causes the movable wall 32 to stop.

In the present embodiment, the inner surface 37K of the container body 37 and the outer surface 32K of the movable wall 32 each have, in a sectional view perpendicularly intersecting the moving direction, a non-circular shape. Further, the outer surface 32K of the movable wall 32 being in close contact with the inner surface 37K of the container body 37 has a similar shape to that of the inner surface 37K. This makes it possible to prevent the movable wall 32 from rotating around (rotating with) the shaft 33 even when the movable wall 32 receives a force for rotation around the shaft 33 owing to the engagement of the male thread 333 and the female thread 370D.

As described above, the present embodiment employs the volume replenishment type toner supply method as shown in FIG. 4. Therefore, when the toner replenishment port 25 is sealed by the accumulation portion 29 (FIG. 4) that has formed in the developing device 20 from below, replenishment toner hardly falls from the toner container 30. On the other hand, when the amount of toner of the accumulation portion 29 has decreased as a result of supply of toner from the developing roller 21 of the developing device 20 to the photoconductive drum 121, toner flows from the toner discharge port 377 into the developing device 20 through the toner replenishment port 25. Consequently, toner that has existed around the toner sensor disappears in the storage space 37S of the toner container 30. This causes the toner sensor to output the LOW signal. Upon receipt of the LOW signal, the controller causes the movable wall 32 to move toward the toner discharge port 377 until the toner sensor outputs the HIGH signal.

The controller causes the stirring member 35 to rotate in response to a developing operation in the developing device 20. Consequently, the stirring member 35 disposed at a right end of the storage space 37S rotates around the shaft 33. This makes it possible to stably stir toner existing above the toner discharge port 377. This increases the fluidity of toner, so that the toner falls through the toner discharge port 377 constantly. In particular, in the present embodiment, the stirring blades 353 project from the stirring supporting portions 352 of the stirring member 35. Therefore, it is possible to actively stir the toner existing around the toner discharge port 377 by the circular movement of the stirring blades 353.

The movable wall 32 reaches the final position lying immediately before the toner discharge port 377 as a result of progressive consumption of toner from the storage space 37S of the toner container 30. In this manner, the movable wall 32 gradually moves in the moving direction to thereby push and convey toner in the storage space 37S to the toner discharge port 377. At this time, the storage space 37S gradually decreases as the movable wall 32 approaches the final position. Therefore, the space that accommodates remaining toner gradually disappears in the toner container 30. Consequently, it is possible to reduce the amount of toner remaining in the storage space 37S of the container body 37 at the end of use of the toner container 30, as compared to the conventional toner container whose storage space volume does not change.

In the present embodiment, the movable wall 32 stops at the final position lying slightly upstream of the toner discharge port 377 in the moving direction. Specifically, when the carrier bearing 32J of the movable wall 32 reaches the movable wall stopper portion 334 as a result of the movement of the movable wall 32, the female thread 320D disengages from the male thread 333. This prevents the shaft 33 from imparting a moving force to the movable wall 32, so that the movable wall 32 stops at the final position. At this time, a space remains above the toner discharge port 377, so that a slight amount of toner remains in the space. However, in the present embodiment, the stirring member 35 is driven for rotation to thereby discharge the toner through the toner discharge port 377 stably and completely. The toner discharge port 377 is formed at a position slightly shifted upward from the lowest part of the container body 37. Even in such configuration, toner that remains in the lowest part of the container body 37 is raised and stably discharged through the toner discharge port 377 by the stirring blades 353.

<Slope of Conveying Surface>

Figure 8A:
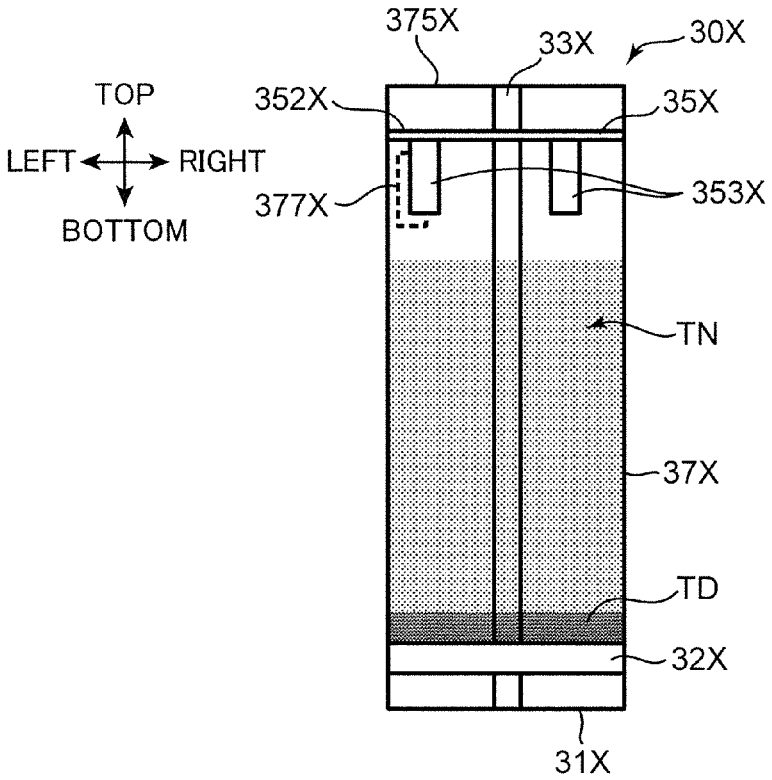
PRIOR ART FIG.8A
FIGS. 8A and 8B are schematic sectional views illustrating developer adhering to a movable wall of a conventional developer container.
Figure 8B:
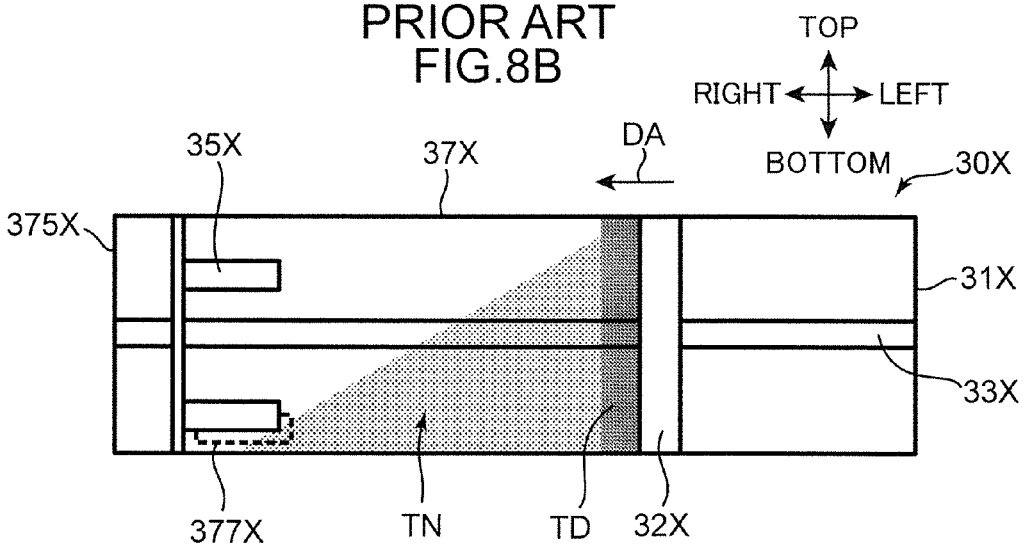
PRIOR ART FIG.8B

FIGS. 8A and 8B are schematic sectional views for explaining a problem of a conventional toner container 30X which is compared with the toner container 30 of the first embodiment. The toner container 30X includes, similarly to the toner container 30, a lid 31X, a movable wall 32X, a shaft 33X, a stirring member 35X, and a container body 37X. The stirring member 35X includes stirring blades 353X, and the container body 37X is formed with a toner discharge port 377X. In FIGS. 8A and 8B, elements that have structures and functions identical to those of the corresponding elements of the toner container 30 of the first embodiment are denoted by the same reference numerals as in FIG. 5 with "X" added at the end.

The toner container 30X is stored in a predetermined place by a user before it is used. At this time, the toner container 30X is likely to be so disposed that a first direction (or the shaft 33X) agrees with a vertical direction as shown in FIG. 8A. In this case, a part of toner TN in the storage space is likely to lightly aggregate and adhere to a conveying surface of the movable wall 32X under the gravity (as adhering toner TD). With reference to FIG. 8B, even after the toner container 30X begins to be used, the toner TD adhering to the conveying surface is unlikely to come off. Consequently, even after the movable wall 32X reaches the final position near the toner discharge port 377X, the toner TD remains adhering to the conveying surface of the movable wall 32X as remaining developer in the toner container 30X. As a result, the toner container 30X is replaced without use of the toner adhering to the conveying surface. Magnetic one-component toner is more likely to lightly aggregate and, therefore, more likely to adhere to the conveying surface of the movable wall 32X than toner of the two-component developer, during storage of the toner container 30X.

Figure 9A:
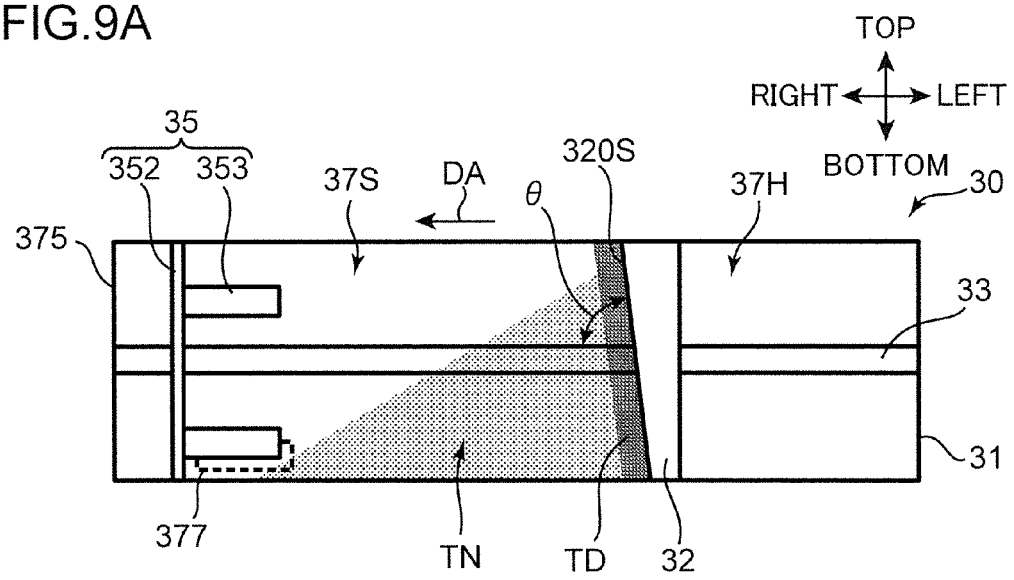
FIGS. 9A and 9B are schematic sectional views of the developer container according to the first embodiment of the present disclosure.
Figure 9B:
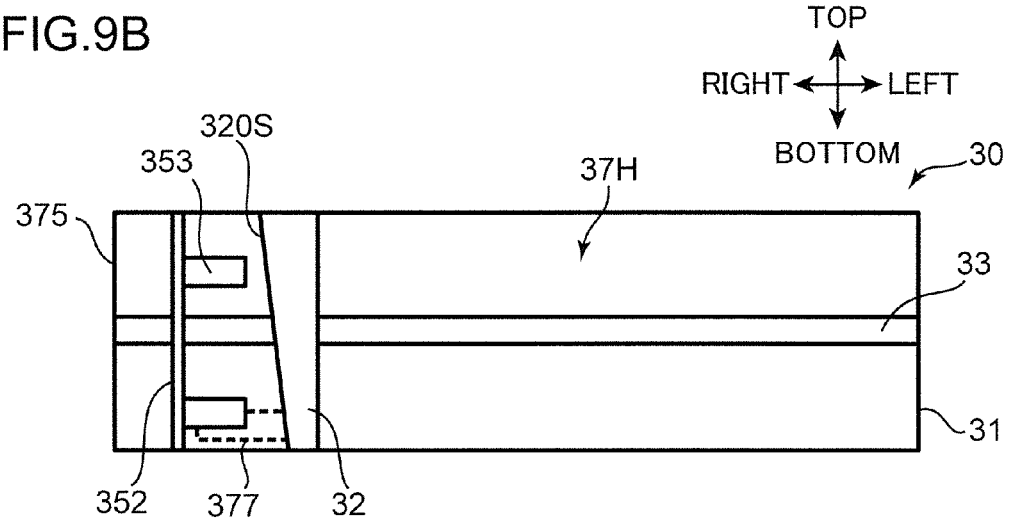

In order to solve this problem, in the present embodiment, the conveying surface 320S of the movable wall 32 is made to extend obliquely. FIGS. 9A and 9B are schematic sectional views of the toner container 30 according to the first embodiment. In this embodiment, the conveying surface 320S extends so obliquely that an upper edge of the conveying surface 320S lies downstream of a lower edge of the conveying surface 320S in the moving direction (in the direction of an arrow DA in FIG. 9A) while the movable wall 32 moves from the initial position to the final position. Therefore, even in the case that the toner container 30 is stored in a vertical orientation before it is used, so that toner TD lightly aggregates and adheres to the conveying surface 320S of the movable wall 32, the conveying surface 320S allows the toner TD to easily come off therefrom. Therefore, it is possible to further reduce the amount of toner remaining in the storage space 37S at the end of use of the toner container 30. During the movement of the movable wall 32, small vibrations caused by the engagement between the female thread 320D of the carrier bearing 32J and the male thread 333 of the shaft 33 are transmitted to the conveying surface 320S. Because the conveying surface 320S is made from the initial position to the final position of the movable wall 32 to extend obliquely, the vibrations of the conveying surface 320S allows the toner TD adhering to the conveying surface 320S to fall more easily. In particular, it is also possible to stably cause magnetic toner that is likely to adhere to the conveying surface 320S to come off from the conveying surface 320S.

As shown in FIG. 9B, when the movable wall 32 reaches the final position near the toner discharge port 377, the toner adhering to the conveying surface 320S is made to fall even more easily by a stirring force of the stirring blades 353 of the stirring member 35. At this time. as shown in FIG. 9B, the upper edge of the conveying surface 320S is spaced from and disposed upstream of the stirring blades 353 of the stirring member 35 in the moving direction. Therefore, even when the movable wall 32 is at the final position, the conveying surface 320S is prevented from coming in contact with the stirring member 35, so that rotation of the stirring member 35 is stably achieved. Therefore, it is possible to discharge toner remaining in the space between the movable wall 32 lying at the final position and the stirring member 35 through the toner discharge port 377.

Further, with reference to FIG. 9A, the angle θ between the conveying surface 320S and the shaft 33 (or the moving direction) is preferred to satisfy the condition: $70° \leq \theta < 90°$. By setting the angle θ to 70 degrees or greater, it is possible to allow toner to fall from the conveying surface 320S while making the volume of the storage space 37S defined between the movable wall 32 lying at the final position and the stirring member 35 small.

Further, with reference to FIG. 9A, the surface of the movable wall 32 that is opposite to the conveying surface 320S extends in the vertical direction (in the top-bottom direction) so as to perpendicularly intersect the shaft 33. This allows the surface of the movable wall 32 that is opposite to the conveying surface 320S, when the movable wall 32 is at the initial position near the lid 31, to lie in close contact with or proximity to the lid 31 of the container body 37. Consequently, a smaller dead space is left in the container body 37, so that a greater amount of toner can be stored in the storage space 37S.

Figure 10:
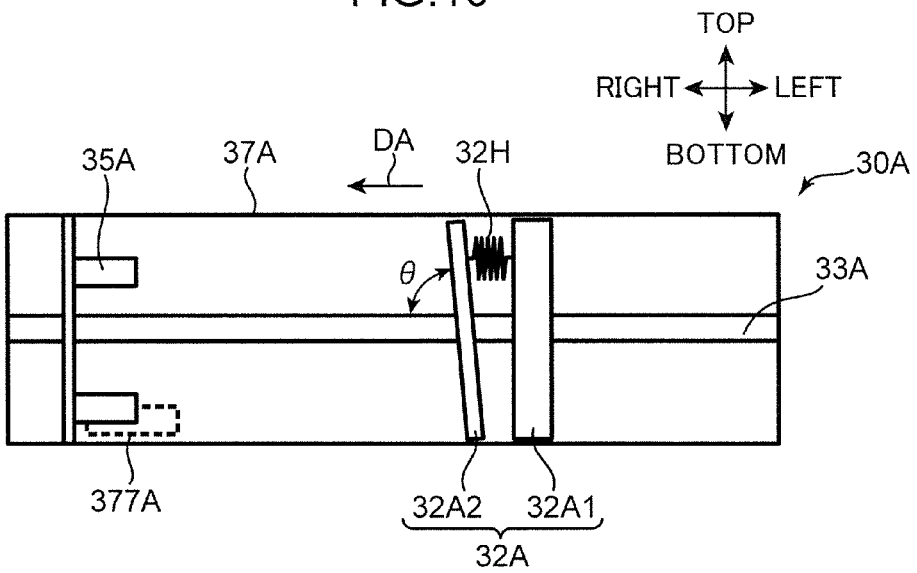
FIG. 10 is a schematic sectional view of a developer container according to a second embodiment of the present disclosure.

Now, a toner container 30A according to a second embodiment of the present disclosure will be described. FIG. 10 is a schematic sectional view of the toner container 30A according to the second embodiment. The second embodiment differs from the first embodiment in the structure of a movable wall 32A. Accordingly, description will be made mainly regarding the difference, and repeated description of other common features will be omitted. The toner container 30A includes the movable wall 32A, a shaft 33A, a stirring member 35A, and a container body 37A. The container body 37A is formed with a developer discharge port 377A.

The movable wall 32A includes an oblique wall portion (first wall portion) 32A2, a main wall portion (second wall portion) 32A1, and a spring (biasing member) 32H. The oblique wall portion 32A2 is in the form of a plate-like wall having a predetermined thickness and is obliquely disposed. In other words, the oblique wall portion 32A2 includes a conveying surface similar to the conveying surface 320S of the first embodiment, the conveying surface extending so obliquely that an upper edge lies downstream of a lower edge in a moving direction (in the direction of an arrow DA shown in FIG. 10). The conveying surface is formed with an unillustrated bearing for allowing the shaft 33A to pass therethrough. The bearing of the oblique wall portion 32A2 has no female thread that engages with a male thread of the shaft 33A. The inner diameter of the bearing is made slightly greater than the outer diameter of the shaft 33A so that the oblique angle of the oblique wall portion 32A2 can be changed. The bearing is provided with an unillustrated elastically deformable seal. Similarly, a seal (not shown) similar to the inner wall seal 322 of the first embodiment is disposed on the outer periphery of the oblique wall portion 32A2.

The main wall portion 32A1 is spaced from and disposed upstream of the oblique wall portion 33A2 in the moving direction. The main wall portion 32A1 is also in the form of a plate-like wall having a predetermined thickness and stands vertically with respect to the shaft 33A. The spring 32H is compressedly disposed between an upper end of the oblique wall portion 32A2 and an upper end of the main wall portion 32A1 to bias the upper end of the oblique wall portion 32A2 downstream in the moving direction. A lower end of the oblique wall portion 32A2 is in contact with an unillustrated restricting projection projecting rightward from a lower end of the main wall portion 32A1. Consequently, the oblique wall portion 32A2 is pivotable with the lower end thereof acting as a fulcrum. The biasing force of the spring 32H is so set in advance as to prevent the upper edge of the oblique wall portion 32A2 from lying upstream of the lower edge of the oblique wall portion 32A2 in the moving direction. Thus, the angle θ between the oblique wall portion 32A and the shaft 33A does not exceed 90 degrees.

Also in this configuration, rotation of the shaft 33A is converted into an axial movement of the oblique wall portion 32A2 and the main wall portion 32A1 via unillustrated male thread and female thread. When the oblique wall portion 32A2 and the main wall portion 32A1 make a movement in the moving direction, the spring 32H is compressed, so that the oblique wall portion 32A2 substantially perpendicularly intersects the shaft 33. Thereafter, when the oblique wall portion 32A2 and the main wall portion 32A1 stop the movement, the spring 32H pushes the oblique wall portion 32A2, so that the oblique wall portion 32A2 inclines. The movable wall 32A moves in the moving direction while the oblique wall portion 32A2 is repeatedly made to incline by the spring 32H. This facilitates toner adhering to the conveying surface of the oblique wall portion 32A2 to fall.

Further, in the second embodiment, when the movable wall 32A is at an initial position, a great amount of toner exists around the oblique wall portion 32A2. Therefore, the oblique wall portion 32A2 being pushed by the spring 32H is restrained from inclining by the toner, so that the angle θ shown in FIG. 10 is great. On the other hand, as the movable wall 32A approaches a final position, the amount of toner contained in the container body 37A decreases. Therefore, the oblique wall portion 32A2 is pushed more strongly by the spring 32H, so that the angle θ shown in FIG. 10 becomes smaller than when the movable wall 32A is at the initial position. In other words, the inclination of the oblique wall portion 32A2 with respect to the vertical direction increases as the movable wall 32A moves from the initial position to the final position. This makes it possible to reliably cause toner adhering to the oblique wall portion 32A2 to come off before the movable wall 32A approaches the toner discharge port 377A. Therefore, the oblique angle of the conveying surface of the oblique wall portion 32A2 can be adjusted according to the amount of toner remaining in a storage space of the toner container 30A. It may be configured such that the upper end of the oblique wall portion 32A2 comes into contact with the stirring member 35A to bring the angle θ back to 90 degrees when the movable wall 32A reaches the final position above the toner discharge port 377A.

Figure 11:
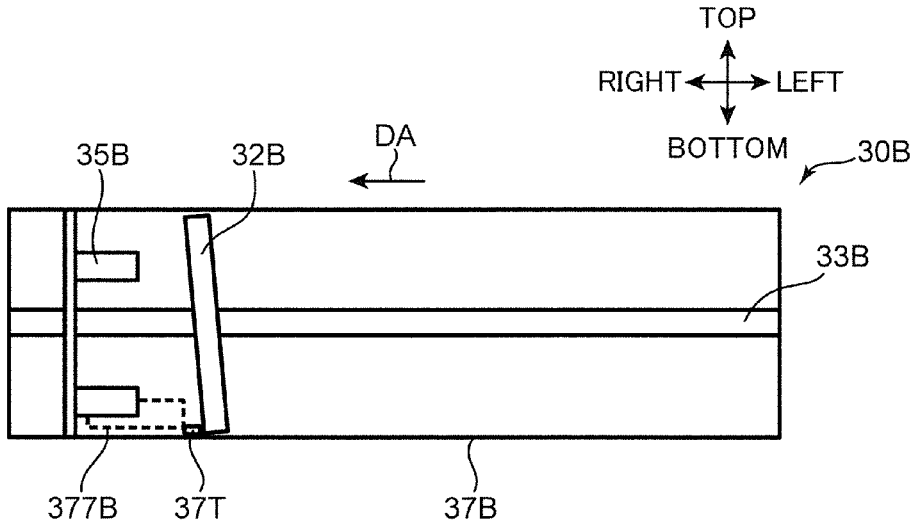
FIG. 11 is a schematic sectional view of a developer container according to a third embodiment of the present disclosure.

Now, a toner container 30B according to a third embodiment of the present disclosure will be described. FIG. 11 is a schematic sectional view of the toner container 30B according to the third embodiment. The third embodiment differs from the first embodiment in the structures of a movable wall 32B and a container body 37B. Accordingly, description will be made mainly regarding the difference, and repeated description of other common features will be omitted. The toner container 30B includes the movable wall 32B, a shaft 33B, a stirring member 35B, and the container body 37B. The container body 37B is formed with a developer discharge port 377B.

The movable wall 32B is in the form of a wall having a predetermined plate thickness. The movable wall 32B extends vertically with respect to the shaft 33B at an initial position. In other words, a conveying surface of the movable wall 32B extends in a vertical direction. Further the container body 37B includes a projection 37T. The projection 37T is in the form of a rib projecting upward from a lower surface of the container body 37B in a storage space and is disposed adjacent to the toner discharge port 377B in the container body 37B. The projection 37T only needs to be disposed near the toner discharge port 377B.

In the third embodiment, when the movable wall 32B reaches a final position, a lower edge of the conveying surface of the movable wall 32B comes into contact with the projection 37T. Thereafter, when the shaft 33B imparts a moving force to the movable wall 32B to move the movable wall 32B in a moving direction by a predetermined distance, the movable wall 32B inclines, so that the conveying surface of the movable wall 32B extends obliquely as shown in FIG. 11. Therefore, it is possible to cause toner adhering to the conveying surface of the movable wall 32B to come off and fall from the conveying surface when the movable wall 32B reaches the final position. The movable wall 32B can incline by the amount of clearance between a female thread formed in an unillustrated carrier bearing and an unillustrated male thread formed in an outer portion of the shaft 33B at the final position. Further, the shaft 33B includes a configuration identical to the movable wall stopper portion 334 (FIG. 5) of the first embodiment to thereby allow the movable wall 32B that has reached the final position to incline easily.

When the movable wall 32B inclines as a result of the contact with the projection 32T, an unillustrated elastic seal disposed on the outer periphery of the movable wall 32B is resiliently compressed between the container body 37B and the movable wall 32B. This may prevent the inclination of the movable wall 32B. Accordingly, a part of the container body 37B that corresponds to the final position of the movable wall 32B may be made to have a greater inner diameter than the other part. The expansion of the inner diameter will release the elastic seal to allow smooth inclination of the movable wall 32B.

Figure 12:
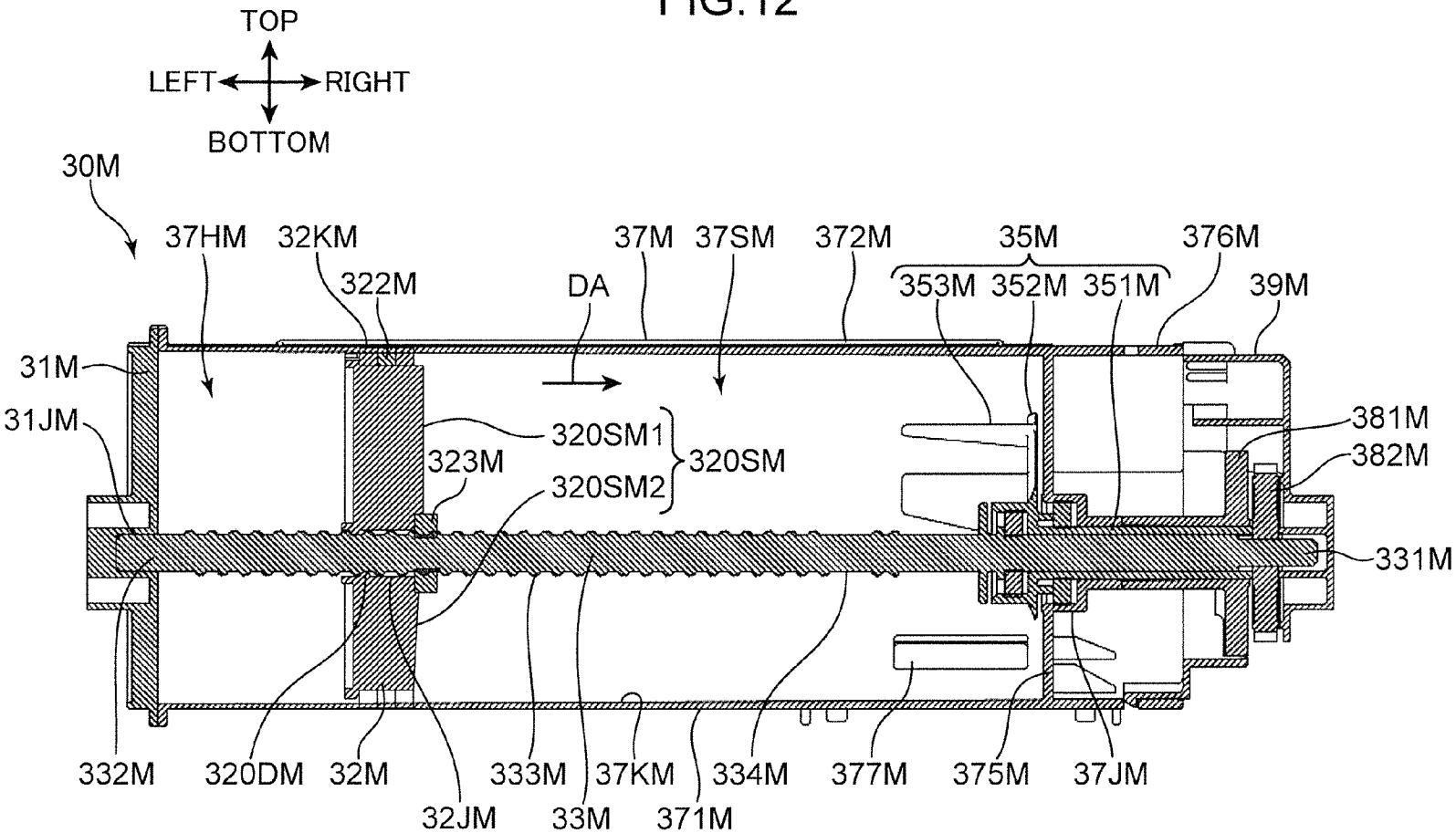
FIG. 12 is a sectional view of a developer container according to a fourth embodiment of the present disclosure.
Figure 13:
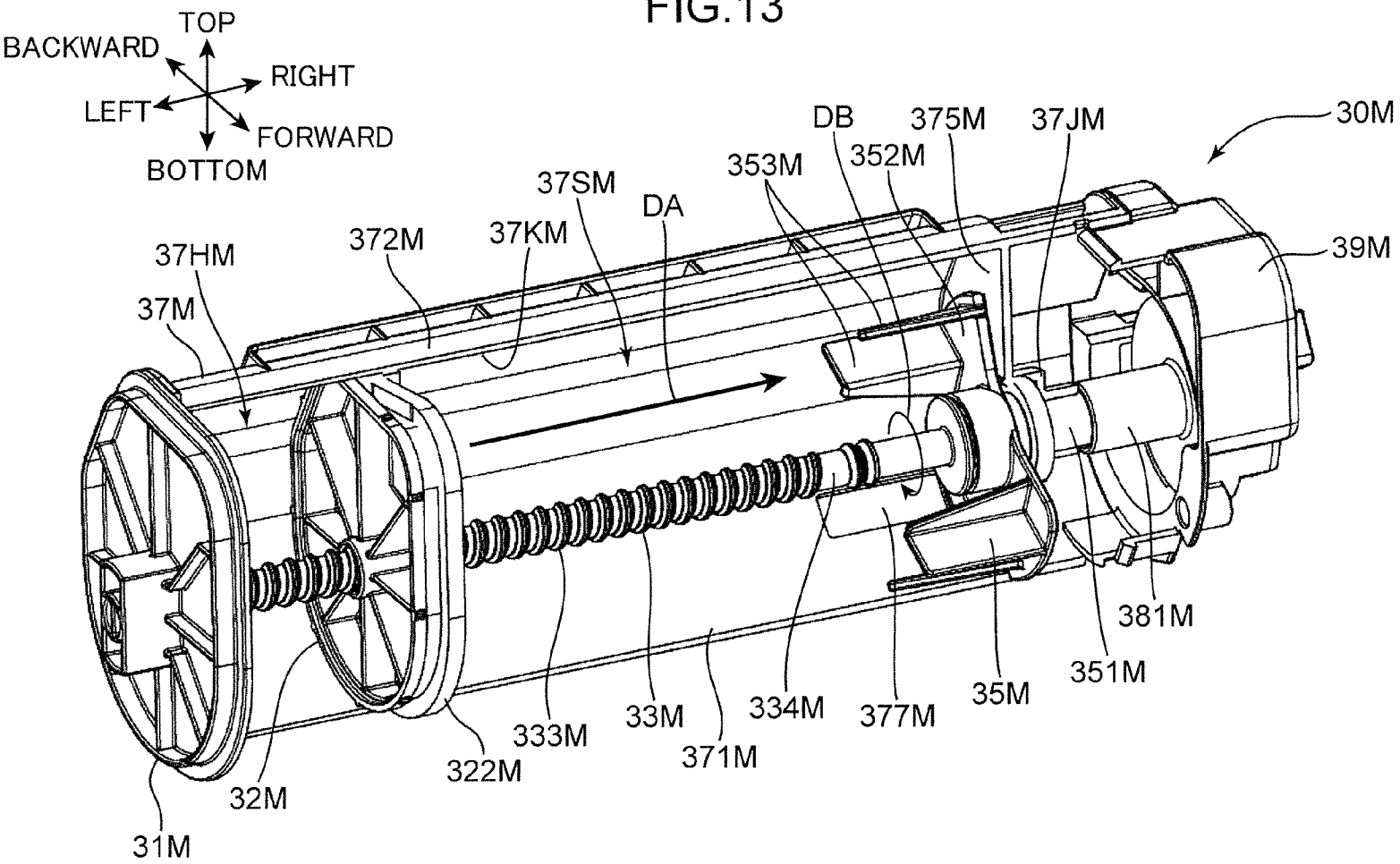
FIG. 13 is a perspective view showing the inside of the developer container according to the fourth embodiment of the present disclosure.
Figure 14:
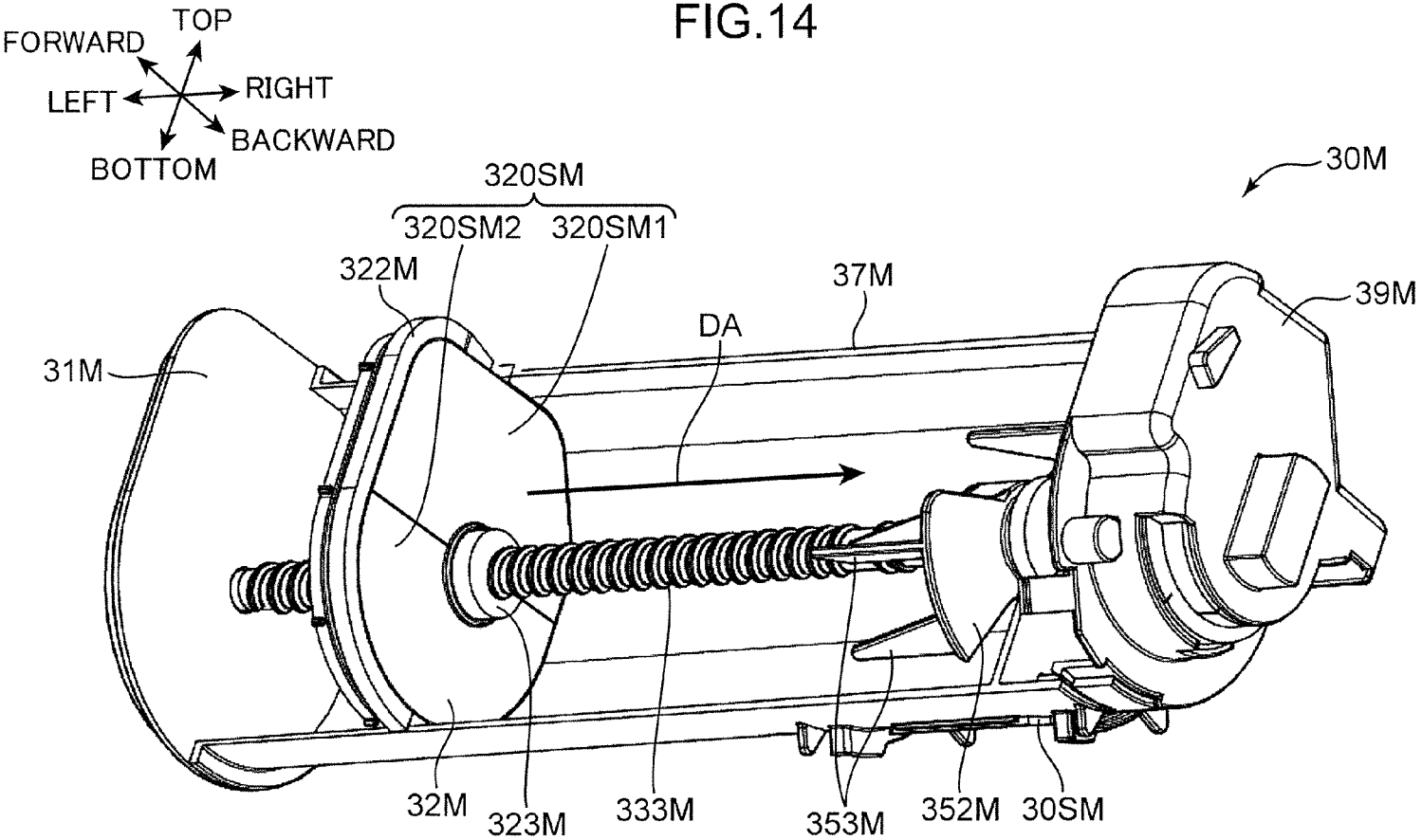
FIG. 14 is a perspective view showing the inside of the developer container according to the fourth embodiment of the present disclosure.

Now a toner container 30M according to a fourth embodiment of the present disclosure will be described. FIG. 12 is a sectional view of the toner container 30M according to the fourth embodiment. FIGS. 13 and 14 are perspective views showing the inside of the toner container 30M according to the fourth embodiment. It should be noted that FIGS. 13 and 14 are perspective views of the toner container 30M, with a part of a container body 37M omitted. The fourth embodiment differs from the first embodiment in the structure of a movable wall 32M. Accordingly, description will be made mainly regarding the difference, and repeated description of other common features will be omitted. In the fifth embodiment, elements that have structures and functions identical to those of the toner container 30 of the first embodiment shown in FIG. 5 are denoted by the same reference numerals as in FIG. 5 with "M" added at the end in FIGS. 12 to 14.

Figure 15A:
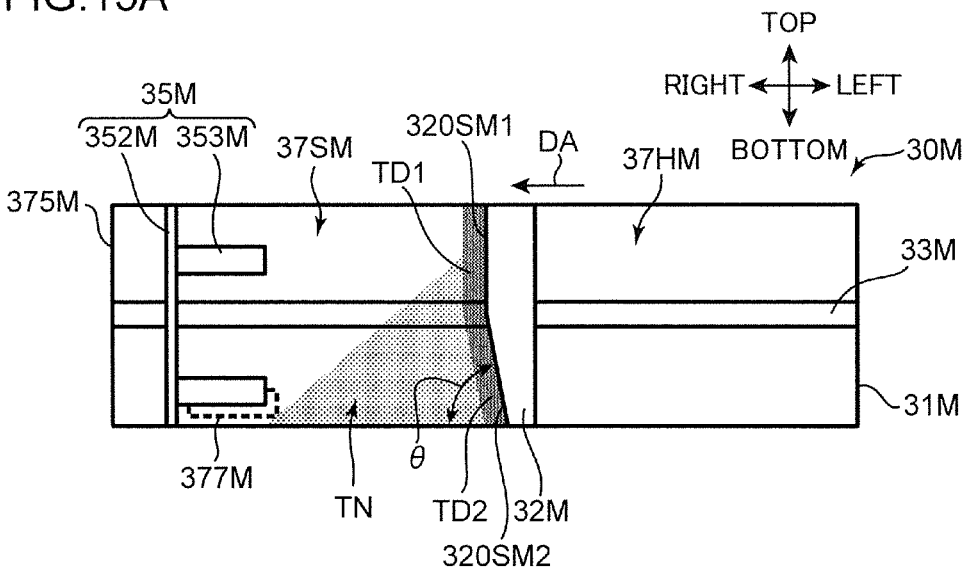
FIGS. 15A and 15B are schematic sectional views of the developer container according to the fourth embodiment of the present disclosure.
Figure 15B:
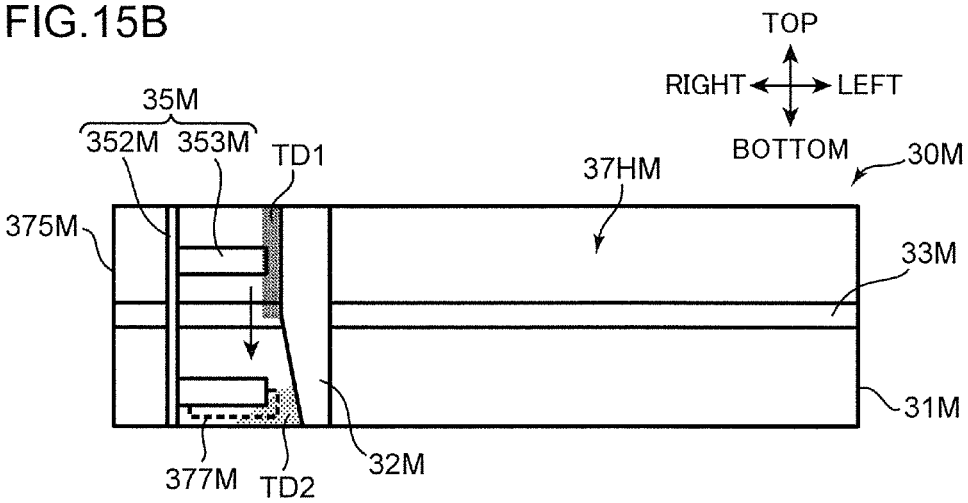

In the fourth embodiment, in order to solve the above-described problem illustrated in FIGS. 8A and 8B, a part of a conveying surface 320SM of the movable wall 32M is made to extend obliquely. FIGS. 15A and 15B are schematic sectional views of the toner container 30M according to the fourth embodiment. With reference to FIGS. 12, 14 and 15A, the conveying surface 320SM includes a first conveying surface portion 320SM1, and a second conveying surface portion 320SM2. The first conveying surface portion 320SM1 defines an upper portion of the conveying surface 320SM and extending in a vertical direction. The second conveying surface portion 320SM2 defines a lower portion of the conveying surface 320SM and joins a lower edge of the first conveying surface portion 320SM1. The second conveying surface portion 320SM2 slopes downward in a direction opposite to a moving direction of the movable wall 32M so that an upper edge of the second conveying surface portion 320SM2 lies downstream of a lower edge of the second conveying surface portion 320SM2 in the moving direction. In the fourth embodiment, the upper edge of the second conveying surface portion 320SM2, i.e. the boundary between the first conveying surface portion 320SM1 and the second conveying surface portion 320SM2, is disposed at the same level as a lower edge of a carrier bearing 32JM (FIG. 12).

According to this configuration, even in the case that the toner container 30M is stored in a vertical orientation before it is used, so that toner TD lightly aggregates and adheres to the conveying surface 320SM of the movable wall 32M, the second conveying surface portion 320SM2 is disposed to slope upward in the moving direction when the toner container 30M is mounted in the printer 100. Therefore, toner TD2 (FIG. 15A) adhering to the second conveying surface portion 320SM2 is likely to fall downward by its own weight in the course of movement of the movable wall 32M. Thus, the toner TD2 can easily come off from the second conveying surface portion 320SM2.

As shown in FIG. 15B, the fall of the toner TD2 adhering to the second conveying surface portion 320SM2 means disappearance of toner that supports toner TD1 adhering to the first conveying surface portion 320SM1. Therefore, the toner TD1 also falls downward as shown by the arrow in FIG. 15B. Thus, the toner adhering to the conveying surface 320SM can be discharged efficiently through a toner discharge port 377M. Consequently, the amount of toner remaining in a storage space 37SM at the end of use of the toner container 30M is further reduced.

During the movement of the movable wall 32M, small vibrations caused by engagement between a female thread 320DM of the carrier bearing 32JM and a male thread 333M of the shaft 33M are transmitted to the conveying surface 320SM. This allows the toner TD adhering to the conveying surface 320SM to fall more easily. In particular, the upper edge of the second conveying surface portion 320SM2 is preferred to be at the same level or above the lower edge of the carrier bearing 32JM. In this case, the carrier bearing 32JM comes into contact with at least a part of the second conveying surface portion 320SM2, which allows the vibrations to be transmitted easily to the second conveying surface portion 320SM2. This allows the toner TD2 to fall from the oblique second conveying surface portion 320SM2 even more easily. Further, the inclusion of the first conveying surface portion 320SM1 and the second conveying surface portion 320SM2 as described above makes it possible to stably cause toner to come off from the conveying surface 320SM even in the case that magnetic toner that is likely to lightly aggregate is adhering to the conveying surface 320SM.

Further, in the case that the first conveying surface portion 320SM1 defines the upper portion of the conveying surface 320SM as in the fourth embodiment, it is possible to make the angle θ (FIG. 15A) between the second conveying surface portion 320SM2 and the moving direction smaller than the angle θ (FIG. 9A) between the conveying surface 320S of the movable wall 32 and the moving direction in the first embodiment, i.e. it is possible to dispose the second conveying surface portion 320SM2 at an acute oblique angle. Therefore, the movable wall 32M enhances the releasability of toner TD, as compared to the movable wall 32 having a same plate thickness.

Further, as shown in FIG. 15B, when the movable wall 32M reaches the final position near the toner discharge port 377, the toner adhering to the conveying surface portion 320SM falls by its own weight even more easily owing to a stirring force of stirring blades 353M of a stirring member 35M. At this time, as shown in FIG. 15B, the first conveying surface portion 320SM1 of the conveying surface 320SM is spaced from and disposed upstream of the stirring blades 353M of the stirring member 35M in the moving direction. Therefore, even when the movable wall 32M is at the final position, the conveying surface 320SM of the movable wall 32M is prevented from coming in contact with the stirring member 35M, so that rotation of stirring member 35M is stably achieved. Therefore, it is possible to efficiently discharge toner remaining in the space between the movable wall 32M lying at the final position and the stirring member 35M through the toner discharge port 377M.

Further, with reference to FIG. 15A, the angle θ between the second conveying surface 320SM2 and the moving direction is preferred to satisfy the condition: $70° \leq \theta < 90°$ By setting the angle θ to 70 degrees or greater, it is possible to prevent toner from aggregating on a lower end of the second conveying surface 320SM2 when the movable wall 32M is at the final position.

Figure 16:
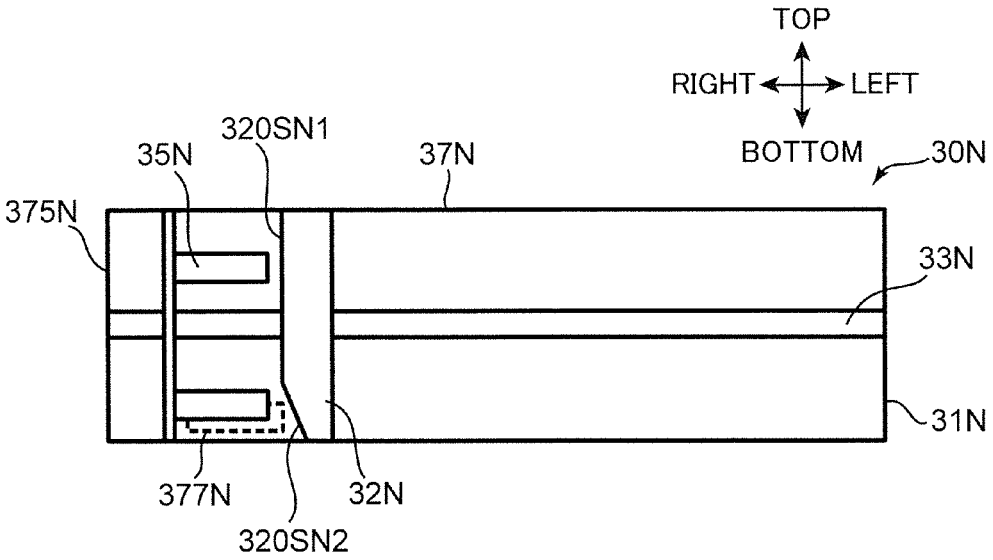
FIG. 16 is a schematic sectional view of a developer container according to a fifth embodiment of the present disclosure.

FIG. 16 is a sectional view of a toner container 30N according to a fifth embodiment of the present disclosure. The toner container 30N includes a movable wall 32N, a shaft 33N, a stirring member 35N disposed near a right wall 375N, and a container body 37N. The container body 37 is formed with a toner discharge port 377N. The movable wall 32N includes a first conveying surface portion 320SN1 and a second conveying surface portion 320SN2. In the fifth embodiment, an upper edge of the second conveying surface portion 320SN2 is disposed below an unillustrated carrier bearing which is disposed in the movable wall 32N to axially support the shaft 33N. Also in this case, when toner adhering to the second conveying surface portion 320SN2 falls by its own weight, toner adhering to the first conveying surface 320SN1 also falls by its own weight or owing to a stirring force of the stirring member 35N. However, in this case, a lower part of the second conveying surface portion 320SN2 defines a wedge-shaped space, in which toner may aggregate. Therefore, in order to prevent the toner aggregation when the movable wall 32N is at a final position, the upper edge of the second conveying surface portion 320SN2 is preferred to be disposed at the same level or above a lower edge of the carrier bearing 32JN as in the fourth embodiment.

The printer 100 including the toner container 30 (30A, 30B, 30M, 30N) according to an embodiment of the present disclosure has been described above. According to this configuration, it is possible to reduce the amount of toner remaining in the storage space 37S of the container body 37 at the end of use of the toner container 30. Therefore, it is possible to stably form an image on a sheet S while efficiently supply the toner in the toner container 30 to the developing device 20. On the other hand, the present disclosure is not limited to the above-described embodiments and, for example, the following modified embodiments may be adopted.

(1) In the above-described embodiments, the printer 100 is illustrated as a monochrome printer. However, the present disclosure is not limited to this configuration. In particular, in the case that the printer 100 is provided as a tandem color printer, after the opening/closing cover 100C (FIG. 1) of the printer 100 is opened, toner containers 30 respectively corresponding to a plurality of colors may be mounted into the housing 101 from above so as to be adjacent to one another.

(2) Further, in the above-described first embodiment, the shaft 33 includes the movable wall stopper portion 334 in addition to the male thread 333. However, the present disclosure is not limited to this configuration. The male thread 333 may be made to extend over the entire shaft 33 in the moving direction. In this case, the stirring member 35 is preferred to include only the stirring supporting portions 352 and no stirring blades 353. It is possible to stir toner existing above the toner discharge port 377 by circular movement of the stirring supporting portions 352. The movable wall 32 may be made to move along the male thread 333 until the conveying surface 320S of the movable wall 32 lies close to the stirring supporting portions 352.

(3) Further, in the above-described first embodiment, the movable wall 32 has a trapezoid shape in sectional view shown in FIGS. 9A and 9B. However, the movable wall 32 may be made to have another sectional shape. For example, the movable wall 32 may be made in the form of a plate-like wall having a substantially uniform thickness like the movable wall 32B shown in FIG. 11. In other words, the surface of the movable wall 32 that is opposite to the conveying surface 320S may be made to extend substantially in parallel with the conveying surface 320S. The plate-like movable wall 32 having the substantially uniform thickness is disposed obliquely. Consequently, the conveying surface 320S is made from the initial position to the final position of the movable wall 32 to extend so obliquely that the upper edge of the conveying surface 320S lies downstream of the lower edge of the conveying surface 320S in the moving direction. Also in this case, it is possible to reduce the amount of toner remaining in the storage space 37S at the end of use of the toner container 30 owing to the movement of the movable wall 32 in the moving direction.

(4) Further, in each of the above-described embodiments, the movable wall 32 (32A, 32B, 32M, 32N) moves from the lid side to the right wall side. However, the present disclosure is not limited to this configuration. The toner discharge port 377 (377A, 377B, 377M, 377N) may be formed on the lid side, so that the movable wall 32 (32A, 32B, 32M, 32N) may be made to move from the right wall side to the lid side.

Figure 17A:
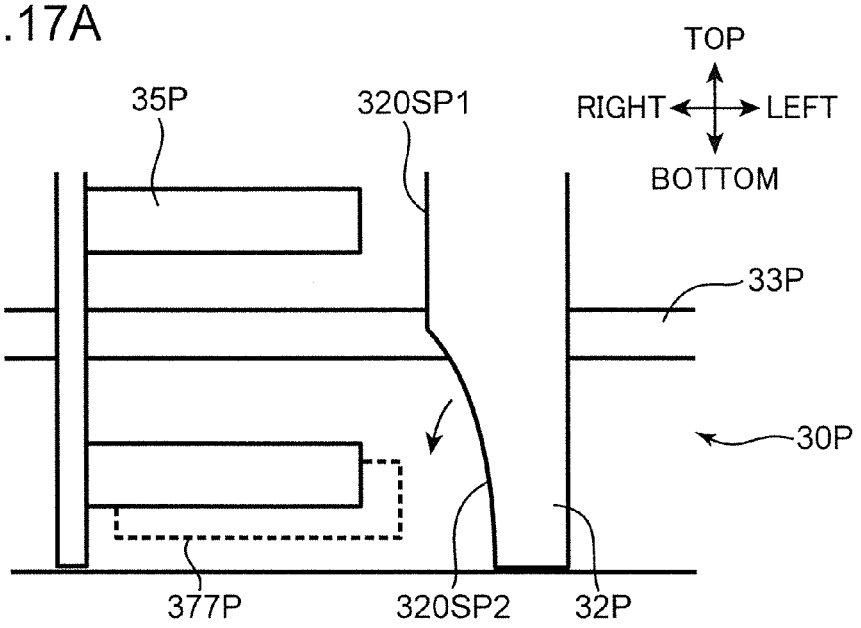
FIGS. 17A and 17B are enlarged sectional views of a part of a developer container according to a modified embodiment of the present disclosure.
Figure 17B:
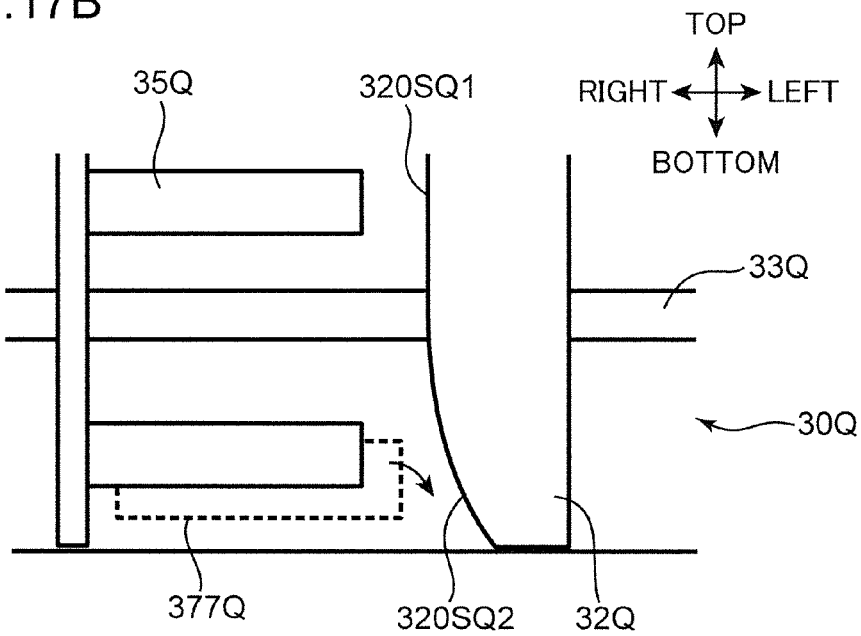

(5) Further, in the above-described fourth embodiment, the second conveying surface portion 320SM2 (FIG. 15A) is configured as a flat surface. However, the present disclosure is not limited to this configuration. FIG. 17A is an enlarged sectional view of a part of a toner container 30P according to a modified embodiment of the present disclosure and FIG. 17B is an enlarged sectional view of a part of a toner container 30Q according to another modified embodiment of the present disclosure. In these sectional views, a movable wall 32P of the toner container 30P and a movable wall 32Q of the toner container 30Q are at respective final positions adjacent to toner discharge ports 377P and 377Q after moving along shafts 33P and 33Q, respectively. As shown in FIGS. 17A and 17B, respective second conveying surface portions 320SP2 and 320SQ2 of the movable walls 32P and 32Q may be curved. Also in these cases, toner adhering to a first conveying surface portion 320SP1 (320SQ1) falls after toner adhering to the second conveying surface portion 320SP2 (320SQ2) falls. Therefore, toner can be discharged efficiently.

With reference to FIG. 17A, in the toner container 30P, the second conveying surface portion 320SP2 of the movable wall 32P curvedly recesses in the moving (right) direction in a sectional side view. In this case, an angle between a tangent to an upper portion of the second conveying surface 320SP2 and a vertical direction is greater than an angle between a tangent to a lower portion of the second conveying surface 320SP2 and the vertical direction. This allows toner adhering to the second conveying surface portion 320SP2 to easily come off from the second conveying surface portion 320SP2 by its own weight or owing to a stirring force of a stirring member 35P.

On the other hand, with reference to FIG. 17B, in the toner container 30Q, the second conveying surface portion 320SQ2 of the movable wall 32Q curvedly projects in the moving (right) direction in a sectional side view. In this case, even when a stirring force of a stirring member 35Q is exerted on the second conveying surface portion 320SQ2 as shown by the arrow in FIG. 17B, toner is prevented from being pushed strongly against the second conveying surface portion 320SQ2. Therefore, the toner can be prevented from being pressed and aggregating on the second conveying surface portion 320SQ2.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developer container, comprising:

a container body including an inner surface defining a cylindrical internal space extending in a first direction, the container body being formed with a developer discharge port communicating with the internal space for discharging developer therethrough; and a movable wall including an outer surface disposed slidably in close contact with the inner surface of the container body, and a conveying surface defining a storage space for containing the developer in cooperation with the inner surface of the container body, the movable wall being movable in a moving direction parallel with the first direction from an initial position at one end side to a final position at the other end side of the internal space while conveying the developer in the storage space to the developer discharge port, wherein at least part of the conveying surface is oblique to the moving direction so that an upper edge of the conveying surface lies downstream of a lower edge of the conveying surface in the moving direction as the movable wall is being moved from the initial position toward the final position.

2. A developer container according to claim 1, wherein the surface of the movable wall that is opposite to the conveying surface extends substantially in parallel with the conveying surface.

3. A developer container according to claim 1, wherein the surface of the movable wall that is opposite to the conveying surface extends in a vertical direction at the initial position.

4. A developer container according to claim 1, wherein the container body includes a projection disposed adjacent to the developer discharge port and extending upward from a lower surface of the container body in the storage space, the movable wall that is at the initial position allows the conveying surface to extend in a vertical direction, and the movable wall that is at the final position allows the lower edge of the conveying surface to be in contact with the projection and the conveying surface to extend obliquely with respect to the vertical direction.

5. A developer container according to claim 1, wherein an oblique angle θ of the conveying surface sloping with respect to the moving direction satisfies the condition: $70° \leq \theta < 90°$.

6. A developer container according to claim 1, further comprising:

a stirring member disposed above the developer discharge port and configured to be driven to rotate to stir the developer in the storage space and cause the developer to flow out through the developer discharge port, wherein when the movable wall is at the final position, the upper edge of the conveying surface is spaced from and disposed upstream of the stirring member in the moving direction.

7. A developer container according to claim 1, wherein the developer includes magnetic one-component toner.

8. An image forming apparatus, comprising:

a developer container according to claim 1;

an image carrier having a surface for allowing an electrostatic latent image to be formed thereon and configured to carry a developed image;

a developing device configured to receive the developer supplied from the developer container and supply the developer to the image carrier; and a transfer section configured to transfer the developed image from the image carrier onto a sheet.

9. A developer container, comprising:

a container body including an inner surface defining a cylindrical internal space extending in a first direction, the container body being formed with a developer discharge port communicating with the internal space for discharging developer therethrough; and a movable wall including an outer surface disposed slidably in close contact with the inner surface of the container body, and a conveying surface defining a storage space for containing the developer in cooperation with the inner surface of the container body, the movable wall being movable in a moving direction parallel with the first direction from an initial position at one end side to a final position at the other end side of the internal space while conveying the developer in the storage space to the developer discharge port, wherein the movable wall includes:

a first wall portion including the conveying surface having the upper edge lying downstream of the lower edge in the moving direction;

a second wall portion spaced from and disposed upstream of the first wall portion in the moving direction; and a biasing member compressed between an upper end of the first wall portion and an upper end of the second wall portion for biasing the upper end of the first wall portion downstream in the moving direction and wherein the movable wall that is at the final position allows the conveying surface to extend so obliquely that an upper edge of the conveying surface lies downstream of a lower edge of the conveying surface in the moving direction.

10. A developer container comprising:

a container body including an inner surface defining a cylindrical internal space extending in a first direction, the container body being formed with a developer discharge port communicating with the internal space for discharging developer therethrough; and a movable wall including an outer surface disposed slidably in close contact with the inner surface of the container body, and a conveying surface defining a storage space for containing the developer in cooperation with the inner surface of the container body, the movable wall being movable in a moving direction parallel with the first direction from an initial position at one end side to a final position at the other end side of the internal space while conveying the developer in the storage space to the developer discharge port, wherein the conveying surface of the movable wall includes:

a first conveying surface portion defining an upper portion of the conveying surface and extending in a vertical direction; and a second conveying surface portion defining a lower portion of the conveying surface, joining a lower edge of the first conveying surface portion, and sloping downward in a direction opposite to the moving direction so that an upper edge of the second conveying surface portion lies downstream of a lower edge of the second conveying surface portion in the moving direction, and wherein the movable wall that is at the final position allows the conveying surface to extend so obliquely that an upper edge of the conveying surface lies downstream of a lower edge of the conveying surface in the moving direction.

11. A developer container according to claim 10, wherein the container body includes an end wall disposed at one end thereof in the first direction and defining an end surface of the internal space, the developer container further comprising:

a lid attached to the other end of the container body that is opposite to the end wall in the first direction for closing the internal space;

a shaft extending in the first direction in the internal space and rotatably supported on the end wall and the lid, the shaft including a first engaging portion in the form of a helical ridge projecting from an outer surface of the shaft and extending in the first direction; and a carrier bearing disposed in the movable wall and having a second engaging portion projecting from an inner surface of the carrier bearing and engageable with the first engaging portion, the carrier bearing allowing the shaft to pass therethrough, and the shaft being rotatable to bring the first engaging portion into engagement with the second engaging portion to thereby move the movable wall along the shaft in the moving direction, wherein the upper edge of the second conveying surface portion is disposed at the same level or above a lower edge of the carrier bearing.

12. A developer container according to claim 10, wherein the second conveying surface portion is curvedly recessed in the moving direction in a sectional side view.

13. A developer container according to claim 10, wherein the second conveying surface portion curvedly projects in the moving direction in a sectional side view.

* * * * *